US006189580B1

(12) United States Patent
Thibault et al.

(10) Patent No.: US 6,189,580 B1
(45) Date of Patent: Feb. 20, 2001

(54) VIAL TRANSFERSET AND METHOD

(75) Inventors: Jean Claude Thibault, Saint-Egreve; Hubert Jansen, Poisat, both of (FR)

(73) Assignee: Becton, Dickinson and Company, Franklin Lakes, NJ (US)

( * ) Notice: Under 35 U.S.C. 154(b), the term of this patent shall be extended for 0 days.

(21) Appl. No.: 09/454,453

(22) Filed: Dec. 6, 1999

Related U.S. Application Data

(63) Continuation of application No. 09/031,302, filed on Feb. 26, 1998, now Pat. No. 6,003,566.

(51) Int. Cl.[7] ..... B65B 1/04
(52) U.S. Cl. ..... 141/25; 141/329; 604/416
(58) Field of Search ..... 141/21–27, 329, 141/330; 604/411–416

(56) References Cited

U.S. PATENT DOCUMENTS

| | | |
|---|---|---|
| 37,221 | 12/1862 | Dunton . |
| 659,519 | 10/1900 | De Oliveria . |
| 2,342,215 | 2/1944 | Perelson . |

(List continued on next page.)

FOREIGN PATENT DOCUMENTS

| | | |
|---|---|---|
| 065 469 A2 | 11/1982 | (EP) . |
| 236 127 A2 | 3/1987 | (EP) . |
| 406 374 B1 | 12/1989 | (EP) . |
| 065 469 A2 | 5/1992 | (EP) . |
| 769 456 A2 | 10/1996 | (EP) . |
| WO 84/04673 | 12/1984 | (WO) . |
| WO 88/01881 | 3/1988 | (WO) . |
| WO 92/11056 | 7/1992 | (WO) . |
| WO 94/03373 | 3/1994 | (WO) . |
| WO 95/00117 | 1/1995 | (WO) . |
| WO 95/03841 | 2/1995 | (WO) . |
| WO 95/14176 | 5/1995 | (WO) . |
| WO 95/31242 | 11/1995 | (WO) . |
| WO 95/33505 | 12/1995 | (WO) . |
| WO 95/35125 | 12/1995 | (WO) . |
| WO 96/13301 | 5/1996 | (WO) . |
| WO 97/00702 | 1/1997 | (WO) . |
| WO 97/10156 | 3/1997 | (WO) . |
| WO 97/39720 | 10/1997 | (WO) . |
| WO 98/13006 | 4/1998 | (WO) . |

OTHER PUBLICATIONS

German Patent No. DE 36 18 158 A1, May 30, 1986.
German Patent No. 501 172, Dec. 31, 1970.
UK Patent Application No. 2 121 016 A, Jun. 1, 1983.
French Patent No. 950.625, Jul. 28, 1947.
French Patent No. 1.071.487, Feb. 26, 1953.
French Patent No. 1.487.413, May 20, 1966.
French Patent No. 2.738.550, Sep. 9, 1995—translation attached.
French Patent No. 2.753.624 A1, Mar. 27, 1998.

*Primary Examiner*—Steven O. Douglas
(74) *Attorney, Agent, or Firm*—Allen W. Wark

(57) ABSTRACT

The improved vial transfer assembly or vial transferset may be attached to a vial under sterile conditions and used to transfer fluid to or from a conventional vial. The transferset includes a tubular transfer member which is sealingly supported on the rim portion of a vial stopper, a piercing member having a piercing end reciprocally supported by an internal surface of the transfer member, a cap enclosing the tubular transfer member and a collar preferably formed of a malleable material which secures the assembly on the stopper, which is crimped beneath the vial rim. The piercing member has a generally longitudinal external channel which, upon piercing the planar portion of the stopper, establishes fluid communication with the vial through the tubular transfer member. The distal end of the tubular transfer member includes a Luer lock for establishing fluid communication to a syringe, IV set or the like. An annular lip on the proximate end of the tubular transfer member stretches and prestresses the central portion of the planar stopper rim and the piercing member is supported in the transferset such that the piercing end deforms the prestressed stopper rim portion.

41 Claims, 10 Drawing Sheets

U.S. PATENT DOCUMENTS 2,388,634 11/1945 De Woody .
2,524,365 10/1950 Smith .
2,607,503 8/1952 Sonnenberg .
2,653,609 9/1953 Smith .
2,659,370 11/1953 Smith .
2,667,986 2/1954 Perelson .
2,953,132 3/1960 Richter et al. .
3,164,303 1/1965 Trautmann .
3,206,080 9/1965 Scislowicz .
3,356,093 12/1967 Monahon .
3,357,427 12/1967 Wittke et al. .
3,610,297 10/1971 Raaf et al. .
3,674,028 7/1972 Ogle .
3,779,371 12/1973 Rovinksi .
3,810,469 5/1974 Hurschman .
3,826,260 7/1974 Killinger .
3,838,689 10/1974 Cohen .
3,872,992 3/1975 Larson .
3,940,003 2/1976 Larson .
3,995,630 12/1976 van de Veerdonk .
4,020,839 5/1977 Klapp .
4,048,999 9/1977 Kobel .
4,067,440 1/1978 Lataix .
4,153,057 5/1979 Kobel .
4,187,893 2/1980 Bujan .
4,210,255 7/1980 Pan .
4,336,891 6/1982 Smith .
4,387,879 6/1983 Tauschinski .
4,412,623 11/1983 Schmidt .
4,418,827 12/1983 Butterfield .
4,425,120 1/1984 Sampson et al. .
4,493,348 1/1985 Lemmons .
4,505,709 3/1985 Froning et al. .
4,507,113 3/1985 Dunlap .
4,564,054 1/1986 Gustavsson .
4,573,976 3/1986 Sampson et al. .
4,576,211 3/1986 Valentini et al. .
4,588,403 5/1986 Weiss et al. .
4,619,651 10/1986 Kopfer et al. .
4,624,393 11/1986 Lopez .
4,662,878 5/1987 Lindmayer .
4,672,996 6/1987 Floyd et al. .
4,673,404 6/1987 Gustavsson .
4,675,020 6/1987 McPhee .
4,792,053 12/1988 Towne et al. .
4,822,351 4/1989 Purcell .
4,826,491 5/1989 Schramm .
4,834,149 5/1989 Fournier et al. .
4,834,152 5/1989 Howson et al. .
4,850,994 7/1989 Zerbet et al. .
4,884,703 12/1989 O'Meara .
4,909,290 3/1990 Coccia .
4,923,447 5/1990 Morgan .
4,927,423 5/1990 Malmborg .
4,932,937 6/1990 Gustavsson et al. .
4,982,740 1/1991 Broden .
5,006,118 4/1991 Yule .
5,024,256 6/1991 Vadjer .
5,035,689 7/1991 Schroeder .
5,060,812 10/1991 Ogle, II .
5,088,996 2/1992 Kopfer et al. .
5,092,840 3/1992 Healy .
5,116,326 5/1992 Schmidt .
5,169,385 12/1992 Turnball .
5,171,214 12/1992 Kolber et al. .
5,215,538 6/1993 Larkin .
5,217,433 6/1993 Bunin .
5,232,029 8/1993 Knox et al. .
5,232,109 8/1993 Tirrell et al. .
5,275,299 1/1994 Konrad et al. .
5,279,576 1/1994 Loo et al. .
5,291,991 3/1994 Meyer .
5,297,599 3/1994 Bucheli .
5,342,319 8/1994 Watson et al. .
5,348,548 9/1994 Meyer et al. .
5,350,372 9/1994 Ikeda et al. .
5,352,196 10/1994 Haber et al. .
5,358,501 10/1994 Meyer .
5,360,413 11/1994 Leason et al. .
5,364,386 11/1994 Fukuoka et al. .
5,385,546 1/1995 Kriesel et al. .
5,397,303 3/1995 Sancoff et al. .
5,409,125 4/1995 Kimber et al. .
5,411,499 5/1995 Dudar et al. .
5,415,374 5/1995 Carroll et al. .
5,419,256 5/1995 Pollich .
5,421,814 6/1995 Geary .
5,423,791 6/1995 Bartlett .
5,425,465 6/1995 Healy .
5,429,256 7/1995 Kestenbaum .
5,433,330 7/1995 Yatsko et al. .
5,433,703 7/1995 Utterberg et al. .
5,437,648 8/1995 Graves et al. .
5,441,487 8/1995 Vedder .
5,454,409 10/1995 McAffer et al. .
5,454,805 10/1995 Brony .
5,466,219 11/1995 Lynn et al. .
5,470,319 11/1995 Mayer .
5,470,327 11/1995 Helgren et al. .
5,474,541 12/1995 Ritsky et al. .
5,474,544 12/1995 Lynn .
5,487,737 1/1996 Meyer .
5,494,170 2/1996 Burns .
5,501,676 3/1996 Niedospial et al. .
5,514,116 5/1996 Vaillancourt et al. .
5,514,117 5/1996 Lynn .
5,520,642 5/1996 Bigagli et al. .
5,520,661 5/1996 Lal et al. .
5,520,665 5/1996 Fleetwood .
5,520,666 5/1996 Choudhury et al. .
5,533,983 7/1996 Haining .
5,533,994 7/1996 Meyer .
5,566,729 10/1996 Grabenkort et al. .
5,573,516 11/1996 Tyner .
5,573,520 11/1996 Schwartz et al. .
5,573,525 11/1996 Watson et al. .
5,573,526 11/1996 Hess .
5,598,939 2/1997 Watson et al. .
5,613,291 3/1997 Solomon et al. .
5,616,129 4/1997 Mayer .
5,616,130 4/1997 Mayer .
5,620,434 4/1997 Brony .
5,685,845 11/1997 Grimard .
5,702,019 12/1997 Grimard .
5,709,666 1/1998 Reynolds .
5,776,124 7/1998 Wald .
5,776,125 7/1998 Dudar et al. .
5,785,701 7/1998 Sams et al. .
5,803,284 9/1998 Grimard .
5,819,964 10/1998 Grimard .
5,873,872 2/1999 Thibault et al. .
5,879,345 3/1999 Aneas .
5,891,129 4/1999 Daubert et al. .
5,925,029 7/1999 Jansen et al. .
5,931,828 8/1999 Durkee .
5,954,104 9/1999 Daubert et al. .
6,003,566 * 12/1999 Thibault et al. ..... 141/25
6,070,623 6/2000 Aneas .
6,071,270 6/2000 Fowles et al. .

* cited by examiner

VIAL TRANSFERSET AND METHOD

This application is a continuation of Ser. No. 09/031,302, filed Feb. 26, 1998 now Pat. No. 6,003,566.

FIELD OF THE INVENTION

This invention relates to an improved vial connector assembly or transferset, a method of affixing a transferset to a vial and a method of establishing fluid communication between a vial and syringe, IV set or the like which permits the use of a conventional or standard vial and syringe or the like to transfer fluid from a syringe to a vial or withdraw liquid medicament, for example, from a vial to a syringe. The improved transferset and method of this invention results in improved aspiration or reaspiration of a vial and improved sealing of the communication between a vial and a syringe.

BACKGROUND OF THE INVENTION

It is now conventional to reduce certain drugs to a dry or powdered form to increase the shelf life of drugs and reduce inventory space. Such dry or powdered drugs are generally stored in a sealed vial and reconstituted into liquid form for administration to a patient by adding a diluent or solvent. A conventional vial includes an open end, a rim surrounding the open end and a reduced diameter neck portion adjacent the rim. The vial is conventionally sealed with an elastomeric stopper which includes a portion inserted into the neck of the vial and a planar rim portion which overlies the vial rim. The stopper is normally secured to the vial rim with an aluminum collar or cap. The aluminum collar includes a tubular portion which surrounds the rim portions of the stopper and vial, an inwardly projecting annular portion which overlies the rim portion of the stopper and a distal portion which is crimped into the vial neck beneath the vial rim portion. Because aluminum is malleable, the collar accommodates the buildup of tolerances of the dimensions of the stopper and vial rim. The dimensions and tolerances of standard vials and stoppers are set by the International Standards Organization (ISO).

A powdered drug is generally reconstituted by inserting the needle of a syringe through the pierceable stopper on the vial and injecting a diluent, such as water, or a solvent into the vial. The reconstituted drug is then reaspirated from the vial with the same or a different syringe after mining the diluent or solvent with the dry drug. As will be understood, this method exposes the healthcare worker to being pricked by the needle of the syringe and contamination of the needle or the drug The prior art has therefore proposed various fluid or liquid transfer assemblies which may be secured to a vial under sterile conditions and which may then utilized to transfer liquid, such as a diluent or solvent, from a syringe to a vial and reconstituted medicament from the vial to a syringe which prevent contamination of the liquid medicament. In the most preferred embodiments, the assembly is protected from contamination by a cap or cover which is removed only prior to use. In the embodiments disclosed in the prior art, the transfer assembly includes a needle which pierces the stopper of the vial and the liquid is transferred through the needle lumen as disclosed, for example, in U.S. Pat. No. 5,429,256. In other embodiments, the conventional vial stopper is eliminated in favor of a fluid transfer assembly having a rubber stopper which is inserted into the neck of the vial without a planar rim portion. The stopper remains within the vial until such time as reconstitution of the drug is required. When the transfer assembly is actuated, the stopper is urged toward the interior of the vial to open the neck, thereby permitting fluid flow through the transfer assembly into the vial body. Examples of such embodiments include the MONOVIAL® line of drug delivery devices manufactured and sold by Becton Dickinson Pharmaceutical Systems of Le Pont de Claix, France and exemplified by U.S. Pat. No. 5,358,501. Although this embodiment is an excellent drug reconstitution system having superior properties, particularly convenience of use and maintenance of the sterile conditions of the drug in the vial, particularly where the vial is of a relatively large size, typically twelve milliliters or more, pharmaceutical companies have expressed an interest in an approach where the vial may also be a smaller size.

The need therefore remains for a vial transferset which may be utilized with an ISO standard vial and stopper to transfer liquid from a conventional syringe to the vial or from a vial to a syringe after reconstituting a drug, for example, which is relatively simple in design and which reduces or eliminates contamination of the drug. It would also be desimble to eliminate the use of a conventional syringe needle to pierce the elastomeric stopper which seals the vial. As will be understood by those skilled in the art, a conventional syringe needle is thin and has an internal axial lumen or bore. The needle must therefore be withdrawn during aspiration of the vial or reaspiration where the medicament is reconstituted in the vial following delivery of a diluent or solvent to the vial. Where the needle is not substantially completely withdrawn during reaspiration of the vial, liquid medicament remains in the vial because the only liquid communication with the syringe is through the needle lumen. This may be a problem particularly where the vial is relatively small. For example, assuming a twenty millimeter long needle which pierces a two to three millimeter thick stopper, if the needle is pushed all the way through the stopper, there may be distance of as much as seventeen millimeters between the needle opening and the inner surface of the stopper. This amount below the needle lumen will not be reaspirated unless the needle is substantially withdrawn.

The vial transferset and method of this invention solves these problems by providing a relatively simple and efficient fluid transfer assembly which may be affixed to an ISO standard vial which assures complete reaspiration of the vial and which does not require accurate positioning of the needle during reaspiration.

SUMMARY OF THE INVENTION

The vial transferset or fluid transfer assembly of this invention is adapted to establish fluid communication between a syringe, intravenous (V) device or the like and a sealed vial. As set forth above, the syringe and vial may be conventional and manufactured according to ISO standards. A conventional vial as presently used by the pharmaceutical companies includes an open end, a rim surrounding the open end and a reduced diameter neck portion adjacent the rim. The vial is sealed with a pierceable resilient stopper generally formed of an elastomeric material and most commonly includes a portion which is inserted into the neck of the vial and a planar rim portion which is received over the vial rim. The central portion of the planar rim portion which overlies the opening through the neck portion of the vial generally has a thickness of about two to three millimeters and the portion of the stopper which is received in the neck portion of the vial is generally tubular having an external diameter which is slightly greater than the internal diameter of the vial neck portion to assure a secure seal.

The transferset or transfer assembly of this invention includes a generally tubular transfer member having an open proximate end which is sealingly supported on the stopper rim portion for example in general coaxial alignment with the vial open end and an opened distal end adapted to receive a syringe or the like in sealed communication. As used in this application, the proximate end of a component such as the tubular transfer member is the end closest to the planar rim portion of the stopper and the distal end is the end furthest from the rim portion of the stopper. As will be understood, these terms are used solely to simplify the explanation of the invention and are not intended to define structure.

The transferset of this invention further includes a piercing member which is received within the tubular transfer member and reciprocally supported within the tubular transfer member by an internal surface of the tubular transfer member. The piercing member includes a relatively sharp preferably pointed piercing proximate end opposite the stopper rim portion adapted to pierce the stopper and an opposed distal end. As discussed more fully hereinbelow, the tubular transfer member provides fluid communication between the vial and a syringe, although the vial transferset of this invention may also be used to transfer fluid or liquid from a vial to another container, such as a second vial or an intravenous set. In the most preferred embodiment of the transferset of this invention, the piercing member includes at least one external generally longitudinal channel or groove rather than an internal lumen, thereby eliminating the problems associated with a conventional needle. Although the channel may take various forms and may include an internal channel, in the most preferred embodiment the channel is an external channel which extends generally longitudinally along at least a portion of the piercing member. As will be understood, the external channel in the piercing member extends generally longitudinally along the piercing member, but may extend spirally around the piercing member or include external and internal channels or multiple channels. Thus, when the piercing member is driven through the rim portion of the stopper, the external channel in the piercing member provides full fluid or liquid communication between the vial and the tubular transfer member. Of course, when the tubular transfer member is sealingly connected to a syringe, IV or the like, the tubular transfer member then provides fluid communication between the vial and the syringe. The preferred embodiment of the tubular transfer member then includes an annular or circular projecting sealing lip which is biased against the planar rim portion of the stopper assuring sealed communication between the vial and the tubular transfer member. In the most preferred embodiment, the sealing lip includes a relatively sharp edge which bites into the resilient stopper. As discussed more fully hereinbelow, the sealing lip of the tubular transfer member is preferably biased against the rim portion of the stopper sufficiently to stretch or prestress the rim portion of the stopper which overlies the vial opening.

The preferred embodiment of the transferset of this invention further includes a cupshaped cap which encloses the assembly and maintains the sterility of the transferset assembly. The cupshaped cap preferably includes a radial rim portion adjacent an open end of the cupshaped cap which preferably sealingly engages the stopper rim portion, a tubular portion surrounding the tubular transfer member and a closed distal end enclosing the distal ends of the tubular transfer member and the piercing member. Although the cap may include a separate cover portion which is integral or separate from the remainder of the cap, in the most preferred embodiment, the cap is integrally formed, such that the distal end portion may be removed prior to use. In the disclosed embodiment, the tubular portion of the cap spaced from the rim portion includes a radial groove or grooves which weaken the tubular wall forming a frangible connection. The distal end of the cap portion may then be removed simply by twisting the distal end of the cap, thereby breaking the frangible connection.

The transfer assembly is secured to the vial by a generally tubular collar having a radially inwardly projecting portion or annular portion which is received over the cap radial rim portion, a tubular portion surrounding the cap radial rim portion and the vial rim and a distal radial rim portion which is received in the vial neck beneath the rim portion of the vial permanently securing the transfer assembly to the vial. In the most preferred embodiment of the transferset of this invention, the collar is formed of a malleable material such aluminum and the radial distal portion of the collar is then crimped into the neck portion of the vial beneath the vial rim portion. The collar of the transferset of this invention thus replaces the aluminum collar of a conventional vial and stopper assembly and easily accommodates the dimensional tolerances of the vial and stopper assembly. The vial is conventionally formed of glass or plastic.

As described above, the planar radial rim portion of the vial stopper is preferably stretched and pressed over the open end of the vial during assembly of the transferset on the vial. The proximate end of the tubular transfer member includes a projecting sealing lip having a diameter less than the internal diameter of the vial open end. In one preferred embodiment, the sealing lip has a relatively sharp edge which may also bite into the resilient stopper. In the most preferred embodiment, the piercing member is reciprocally supported by an internal surface of the tubular transfer member, such that the piercing member can move toward the stopper to pierce the stopper, but the piercing member is prevented from moving away from the stopper and the relatively sharp piercing proximate end of the piercing member extends beyond the proximate end of the tubular transfer member. Upon assembly of the transferset on the vial, the piercing end of the piercing member then deforms and, in one disclosed embodiment, partially penetrates the planar rim portion of the stopper which is preferably stretched and prestressed over the vial opening by the sealing lip of the tubular transfer member, as described above. This combination may reduce the force required for the piercing member to fully pierce the planar rim portion of the stopper upon activation which is another advantage of the present invention. In another disclosed embodiment, the piercing end of the piercing member is slightly rounded and the external channel does not extend through the proximate end, such that the relatively sharp piercing end does not initially penetrate the rim portion of the stopper, but stretches the stopper as described. This embodiment strengthens the piercing end. Further, deforming the stopper planar rim portion and stretching the planar portion over the open end of the vial, reduces the volume of elastomeric material deformed into the V-shaped groove or external channel in the piercing member following piercing of the stopper, thereby improving fluid flow through the channel. In the disclosed embodiment, the tubular transfer member includes an internal diameter adjacent its distal end which is smaller than the internal diameter adjacent its proximate end and the piercing member includes a radial lip having a diameter greater than the smaller internal diameter of the tubular transfer member adjacent its distal end. Stated another way, the tubular transfer member has a larger counter bore adjacent its proximate end. The piercing member is thus free to move telescopically in the tubular transfer member toward the stopper, but prevented from moving away from the stopper. In the most preferred embodiment, the piercing member has a reduced diameter portion adjacent its proximate end and a pointed piercing end further reducing the force required to drive the piercing member through the planar rim portion of the stopper.

The most preferred embodiment of the transferset of this invention further includes a second seal surrounding the seal provided by the sealing lip of the tubular transfer member. In this preferred embodiment, the second seal is provided by an annular or circular lip which projects from the radial rim portion of the cap. In the most preferred embodiment, the radial rim portion of the cap includes at least one relatively sharp sealing lip which bites into the planar rim portion of the stopper providing an improved seal which maintains the sterile condition of the content of the transferset and prevents contamination.

As described above, the transferset of this invention may be affixed on a conventional vial and stopper assembly by the pharmaceutical companies under sterile conditions when the vial is filled and the transferset of this invention prevents contamination of the contents of the vial. The cap of the transferset seals the transfer assembly and the collar permanently secures the assembly on the vial, particularly where a malleable collar is utilized. The radially inwardly projecting or annular lip portion of the collar is preferably compressed against the radial rim portion of the cap as the distal end of the collar is crimped into the reduced diameter-neck portion of the vial beneath the vial rim during assembly. This compression against the resilient planar rim portion of the stopper compresses the sealing lips of the cap and the tubular transfer member against the rim portion of the stopper, such that the sealing lips bite into the rim portion of the stopper assuring sealed communication between the stopper and the tubular transfer member. In the most preferred embodiment, the piercing end of the piercing member is also partially driven into the prestressed rim portion of the stopper overlying the open end of the vial, reducing the stroke required to drive the piercing member through the rim portion of the stopper as described above.

The method of assembling the improved transferset of this invention on a vial then includes inserting the elongated piercing member into the tubular transfer member, wherein the internal surface of the tubular transfer member telescopically supports the piercing member. Where the tubular transfer member includes an enlarged counterbore adjacent its proximate end and the piercing member includes a radial lip as described, the distal end of the piercing member is inserted through the proximate end of the tubular transfer member and the relatively sharp piercing end of the piercing member extends beyond the proximate end of the tubular transfer member. The method then includes inserting the distal end of the tubular transfer member into the open proximate end of the cupshaped cap. In the most preferred embodiment of the transferset, the proximate end of the tubular transfer member includes a radial lip portion which is received within a counterbore of the radial rim portion of the cap, fixing the tubular transfer member in the cap, such that the projecting sealing lip of the tubular transfer member engages the planar rim of the stopper as described. Further, the piercing member is preferably releasably retained in the tubular transfer member, such that the components of the transferset and the collar may be preassembled and delivered in bulk to a pharmaceutical company, for example, for sterile assembly on vials. Finally, the assembled piercing member, tubular transfer member and cap are assembled on the vial and affixed by the collar. As described, the collar is most preferably formed of a malleable material such as aluminum and the radial rim portion of the collar is compressed against the rim portion of the cap as the distal end of the generally tubular cap is crimped into the reduced diameter neck portion of the vial beneath the vial rim. The compression of the radial rim portion of the collar against the rim portion of the cap compresses the resilient planar rim portion of the stopper, compressing the sealing lips into the rim portion of the stopper, stretching and prestressing the central portion of the planar rim portion of the stopper, assuring sealed communication between the vial and the tubular transfer member. In the most preferred embodiment, the method of this invention further includes driving the piercing end of the piercing member simultaneously into the planar radial rim of the stopper, deforming and may partially penetrate the stopper radial rim to reduce the stroke required to drive the piercing member through the stopper.

The method of transferring fluid or liquid medicament from the vial to a syringe or other container then includes first removing the cover portion of the cap to provide access to the tubular transfer member and the piercing member. In the most preferred embodiment, a radial groove is provided in the tubular portion of the cap spaced from the radial portion of the cap providing a frangible connection, such that the cover portion can be removed from the rim portion of the cap simply by twisting the distal end of the cap, breaking the frangible connection and permitting removal of the cover portion which includes the distal end of the tubular portion of the cap the closed end.

The transferset and vial assembly is now ready for use. As set forth above, the transferset of this invention may be utilized to transfer fluid from a vial to a syringe or IV set or any container; however, the disclosed embodiment of the transferset is specifically adapted to transfer liquid from a vial to a syringe or IV set or from a syringe or IV set to a vial. The distal end of the tubular transfer member includes a connector adapted to connect the tubular transfer member to a syringe to establish fluid communication between the tubular transfer member and the interior of a syringe, such as a Luer lock or Luer connector. A conventional syringe includes a tubular portion, a plunger having a head or fluid piston reciprocally mounted in sealed relation within the tubular portion and a reduced diameter tubular nozzle portion opposite the plunger head. The inside diameter of the tubular transfer member of the transferset is preferably greater than the outside diameter of the tubular nozzle portion of the syringe and the outside diameter of the syringe nozzle portion is generally approximately equal to the diameter of the distal end of the piercing member. Thus, the syringe nozzle portion may be telescopically received within the distal end of the tubular transfer member, wherein it is driven against the distal end of the piercing member. The reduced diameter nozzle portion is generally recessed within the tubular portion of the syringe, such that the proximate end of the syringe tubular portion surrounds the nozzle portion forming a tubular collar. The proximate end of the tubular collar includes a connector, such as a female Luer lock. In the disclosed embodiment, the distal end of the tubular transfer member includes a male Luer lock connector adapted to mate with the female Luer lock of the syringe.

Following removal of the cover portion of the cap as described above, the connector on the syringe is connected to the connector on the distal end of the tubular transfer member which drives the reduced diameter nozzle portion of the syringe into the distal open end of the tubular transfer member and the free end of the syringe nozzle portion is then driven against the distal end of the piercing member, driving the piercing end of the piercing member through the planar rim portion of the stopper. In summary, the method includes connecting the syringe to the distal end of the tubular transfer member, establishing fluid communication between the syringe trough the nozzle portion and driving the piercing end of the piercing member through the rim portion of the stopper. Fluid communication is thus established between the inside of the vial and the syringe through the tubular transfer member.

In the most preferred embodiment of the transferset of this invention, wherein the piercing member includes an external generally longitudinal channel, this communication is established through the external generally longitudinal channel in the piercing member. In the most preferred embodiment, the channel in the piercing member extends from adjacent the piercing end to at least the enlarged portion of the piercing member and most preferably through at least an extended portion of the length of the piercing member. The connector on the syringe is most preferably a treaded connection, such as a Luer lock. In one embodiment, this threaded connection has several turns whereby the proximate end of the piercing member is driven completely through the planar rim portion of the stopper by threading the threaded connection of the syringe on the distal end of the tubular transfer member. In another embodiment, the proximate end of the piercing member is driven through the stopper by fluid pressure from the syringe.

As will now be understood, the piercing member in the transferset of this invention has several important advantages over the prior art. First, the piercing member is easy to manufacture. The longitudinal channel may be a V-shaped channel for example which extends the entire length of the piercing member. Such a channel is easier to manufacture than a needle having very small lumen as presently used. More importantly, in the transferset of this invention, a piercing member having an external channel assures complete aspiration or reaspiration of the vial without requiring partial withdrawal of the needle which exposes the healthcare worker to being pricked by the needle (if inadvertently fully withdrawn) and contamination of the liquid medicament. The external channel provides full communication of the liquid content of the vial, whereas a needle with a lumen requires substantial withdrawal of the needle from the vial to provide full communication through the stopper as described above. Fluid communication between the syringe and the vial is then provided by the tubular transfer member rather than the needle in the transferset of this invention. Thus, the described piercing member provides several important advantages in the transferset of this invention over the prior art.

As described, the transferset of this invention may be utilized to reconstitute dry or powdered drugs into liquid form with an appropriate diluent or solvent solution prior to administration to a patient. For example, the syringe may contain a solvent solution or diluent which is injected into the vial through the tubular transfer member and the external channel of the piercing member by depressing the plunger head of the syringe. The reconstituted drug or medicament may then be reaspirated from the vial to the same syringe by withdrawing the plunger head for administration to a patient. The healthcare worker is never exposed to a needle during this operation and the piercing member remains with the transferset and vial assembly because it is never connected to the syringe. The tubular transfer member is then removed from the syringe and replaced with a needle for application of the liquid medicament to a patient or connected directly to an IV line.

As will be understood, the terms tubular and tubular portion are used herein to connote a generally tubular shape. Although the disclosed embodiments are generally cylindrical tubes which are more convenient to manufacture, the tubular portions may be of any convenient shape, including polygonal. Other advantages and meritorious features of the present invention will be more fully understood from the following description of the preferred embodiments, the claims and the appended drawings, a brief description of which follows.

DETAILED DESCRIPTION OF THE PREFERRED EMBODIMENT

Figure 1:
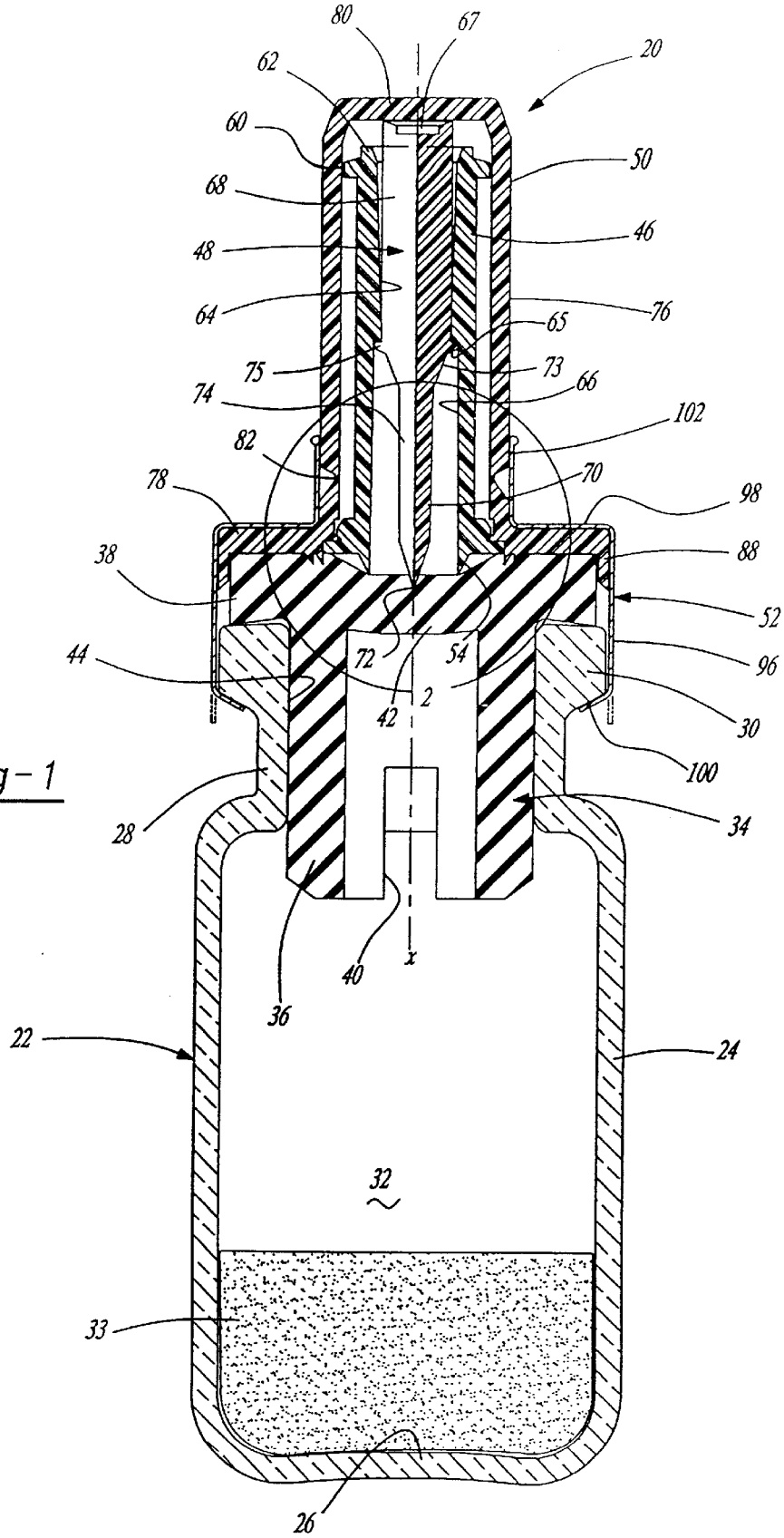
FIG. 1 is a side cross-sectional view of an assembled vial and fluid transfer assembly or transferset.

As described above, the fluid transfer assembly or transferset 20 of this invention is adapted for establishing fluid communication with a conventional sealed vial 22 as shown in FIG. 1. The vial includes a side wall portion 24, a bottom wall portion 26, a reduced diameter neck portion 28 and a rim portion 30. The vial is conventionally formed of glass or plastic and includes an interior 32 for receipt for example of a dry or liquid medicament, such as a dry vaccine 33. The vial is sealed with an elastomeric stopper 34 which includes a tubular portion 36 and a planar rim portion 38. The tubular portion 36 of the stopper preferably has an external diameter slightly greater than the internal diameter 44 of the open end of the vial and, as will be understood by those skilled in the art, the end of the tubular portion may include axial slots 40 in order to perform freeze drying of liquid in the vial. As will be understood, the vial may also include a gas, for example, to protect the liquid content of the vial, and thus the transferset of this invention is referred to as a fluid, rather than liquid transferset. The central portion 42 of the planar rim portion 38 is flexible and thus may be resiliently biased into the tubular portion 36, prestressing the central portion 42 as described below.

Figure 2:
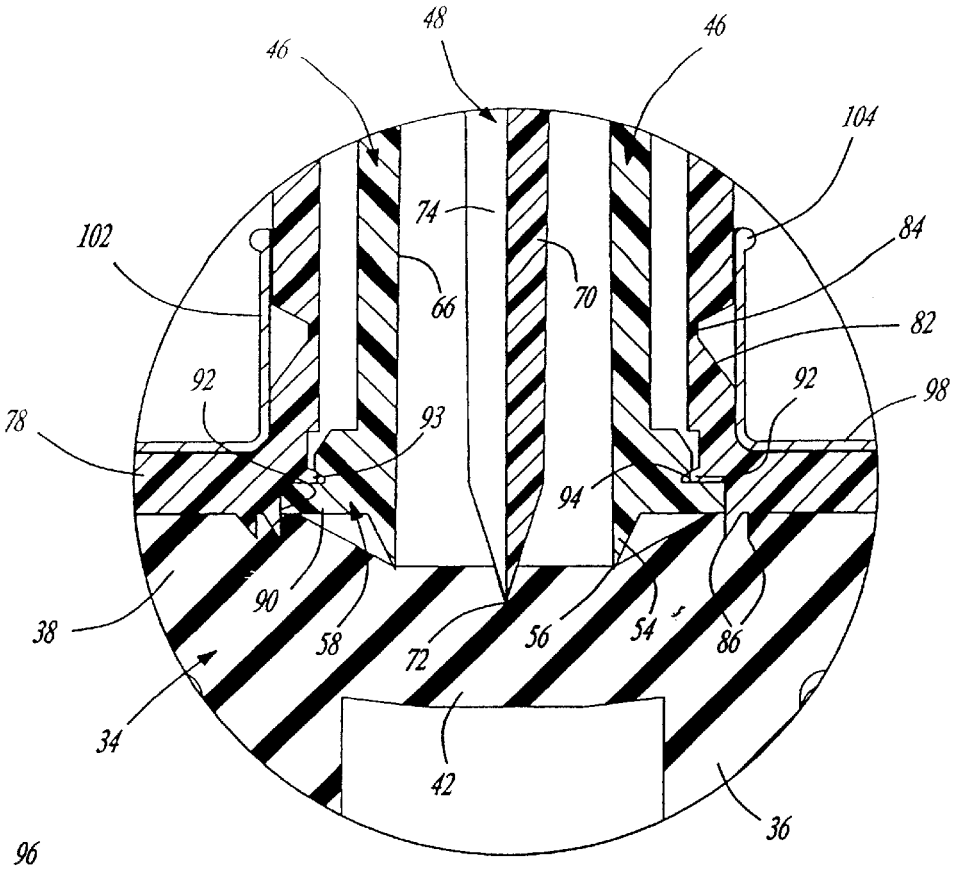
FIG. 2 is an enlarged view of the encircled portion 2 shown in FIG. 1.

The transferset 20 of this invention preferably includes four components, including a tubular transfer member 46, a central piercing member 48 which is reciprocally supported in the tubular transfer member, a cup-shaped cap 50 which encloses and seals the assembly and a collar member 52 which secures the transferset to the vial as shown in FIG. 1. The proximate end of the tubular transfer member 46 includes a circular or annular sealing lip 54 as shown in FIGS. 1 and 2, which preferably includes a sharp distal edge 56 as shown in FIG. 2. As will be understood, the proximate end of the tubular transfer member 46 may include a plurality of sealing lips, such as the concentric sealing lips 86 of the cap 50 described below. In the disclosed embodiment, the proximate end of the tubular transfer member 46 further includes a radial connector portion 58 as shown in FIG. 2 which is described more fully hereinbelow. A connector, such as a Luer lock 60, is provided adjacent the open distal end 62 of the tubular transfer member. The internal surface of the tubular transfer member 46 includes a first smaller preferably conical diameter 64 adjacent the distal end 62 and a second larger generally cylindrical diameter 66 or counterbore adjacent the proximate end.

The distal end 67 of the piercing member 48 includes a generally cylindrical barrel portion 68 having an external diameter generally equal to or slightly less than the internal diameter 64 of the tubular transfer member 46, such that the piercing member is telescopically supported in the tubular transfer member 46 for movement toward the stopper 34 as described below. The piercing portion 70 adjacent the proximate end of the piercing member 48 may also be generally cylindrical and preferably has a diameter substantially less than the diameter of the barrel portion 68. In the disclosed embodiment, the portion 73 of the piercing member between the radial rib 75 and the barrel portion 68 is conical. The proximate end of the piercing member 48 includes a relatively sharp, preferably pointed piercing end 72 and the piercing member 48 includes an external generally longitudinal channel 74 which provides communication between the interior 32 of the vial and the interior of the tubular transfer member 46 as described below.

The piercing member 48 further includes a radial rib 75 which has a diameter greater than the inside diameter 64 of the tubular transfer member 46 adjacent its distal end and slightly smaller than the inside diameter 66 of the counterbore, such that the piercing member 48 can move toward the planar radial rim portion 38 of the stopper for piercing of the stopper, but cannot move away from the stopper as shown in FIG. 1. In the preferred embodiment of the transferset of this invention, the sharp piercing end 72 of the piercing member 48 is thus retained in the tubular transfer member 46, such that the relatively sharp piercing end portion 72 of the piercing member deforms the central portion 42 of the stopper and may partially penetrate the stopper as shown, thereby reducing the stroke required to drive the piercing member through the stopper as described below.

The cap 50 includes a tubular portion 76 which surrounds the tubular transfer member 46 preferably is spaced relation, a radial rim portion 78 at its proximate end and a closed distal end portion 80 which encloses the distal ends of the tubular transfer member 62 and the piercing member 67. The cap 50 is thus generally described as "cupshaped"; however, the cap may have an open distal end which is closed by a separate removable closure, for example, such that the combination is cup-shaped. The tubular portion 76 of the cap includes a radial v-shaped external groove 82, such that the proximate end of the tubular portion 76 is retained to the distal portion by a relatively thin frangible connection 84 as shown in FIG. 2. The groove 82 in the disclosed embodiment of the tubular portion 76 of the cap 50 is in the external surface as shown; however the groove may also be formed in the internal surface forming a frangible connection adjacent the external surface. The groove 82, whether internal or external, may also be continuous as shown or interrupted. Alternatively, the cover portion may be connected to the remainder of the cap by spaced frangible connector portions. As described below, the distal portion of the cap or cover portion may then be removed by twisting the distal end of the cap for connection of the transferset to a syringe or the like. In the preferred embodiment of the transferset, the radial rim portion 78 includes annular or preferably circular concentric sealing lips 86 which surround the sealing lip 54 of the tubular transfer member. As shown in FIG. 2, the circular lips 86 on the radial portion 78 of the cap surround the sealing lip 54 on the tubular transfer member, providing a safety seal primarily to maintain sterility inside the cap 50 prior to use, thereby extending the shelf life of the product. Although the disclosed embodiment includes two concentric sealing lips 86 on the cap, it will be understood that one sealing lip may be utilized or a plurality of nonconcentric lips. The sealing lips 86 preferably have a relatively sharp edge and are V-shaped, such that the lips 86 bite into the resilient planar rim portion 38 of the stopper.

The disclosed embodiment of the cap 50 further includes an outer longitudinal rim portion 88 having an inside diameter generally equal to or slightly smaller than the outside diameter of the planar rim portion 38 of the stopper as shown in FIG. 1, such that the transferset 20 is accurately located on the stopper 34 and the rim portion 30 of the vial 22 with the tubular transfer member 46 generally coaxially aligned with the opening 44 through the neck portion 28 of the vial. In the disclosed embodiment, the piercing member 48 is supported in the tubular transfer member 46 with its longitudinal axis X coincident with the longitudinal axis of the vial and stopper. It may be desirable, however, in certain applications to provide a nonconcentric arrangement and thus the present invention is not limited to the concentric arrangement shown. The tubular transfer member 46 is accurately located and supported within the cap 50 by a radial rim 90 on the radial connector portion 58 as shown in FIG. 2, which is received in a recess 92 in the cap. The cap further includes a V-shaped radially inwardly projecting rib 93, which is received in or snapped into a V-shaped groove 94 in the tubular transfer member as shown in FIG. 2, providing accurate secure location of the tubular transfer member 46 in the cap 50.

The V-shaped interlock further permits preassembly of the tubular transfer member 46 and piercing member 48 in the cap 50 for bulk supply of the transferset and collar 52 to pharmaceutical companies, for example, for attachment to a vial, following filling of the vial with medicament, using the collar 52. In an alternative embodiment (shown in FIGS. 16 to 18 described below), the tubular transfer member is retained in the cap 350 for bulk supply by an interlocking rib and depression on opposed surfaces of the tubular transfer member and the cap, preferably spaced inwardly or proximately from the frangible connection. Further, in the embodiment described below, the piercing member is releasably retained in the tubular transfer member for bulk assembly and supply to the applicator responsible for filling the container or vial 22. Thus, as will be understood, various embodiments or means may be provided to retain the tubular transfer member 46 in the cap for bulk supply to pharmaceutical companies for later assembly on a vial within the purview of this invention. In the disclosed embodiment, the piercing member 48 includes a small ramped radial rib 73, spaced distally from the radial rib 75, which provides an interference fit with the internal surface 64 of the tubular transfer member 46 as best shown in FIGS. 5, 6, 9 and 10. This interference fit releasably retains the piercing member 48 in the tubular transfer member 46 upon assembly of the piercing member in the tubular transfer member. Thus, the components of the transferset 20 are retained as an assembly for bulk sale and use as described.

As set forth above, the collar 52 is most preferably formed of a malleable material such as aluminum to accommodate the thickness tolerances of the stopper 34 and the rim portion 30 of the vial. The collar 52 includes a tubular portion 96 which surrounds the radial and longitudinal rim portions 78 and 88 of the cap 50, the planar radial rim portion 38 of the stopper and the rim portion 30 of the vial, a radially inwardly projecting portion 98 which overlies the radial rim portion 78 of the cap and a distal radial portion 100 which in the preferred embodiment is crimped into the reduced diameter neck 28 of the vial beneath the vial rim 30. In the disclosed embodiment, the collar 52 further includes a distal tubular portion 102 which surrounds the proximate end of the tubular portion 76 of the cap and the radial V-shaped external groove 82 as shown in FIG. 2. This tubular portion 102 reduces the likelihood of accidental removal of the distal portion of the cap 50 and the distal end of the tubular portion 102 includes a rounded bead 104 which prevents the healthcare worker from engaging a sharp metal edge when removing the distal end of the cap during use. The distal removable portion of the cap is referred to hereinafter as the cover portion. Alternatively, the cover portion may be threaded onto the proximate end of the tubular portion 76 of the cap or connected by a "living hinge." However, the preferred embodiment of the cap 50 having a frangible connection 84 as shown in FIGS. 1 and 2 reduces the cost of the cap of the transferset and assures maintenance of the sterile conditions prior to use.

Figure 9:
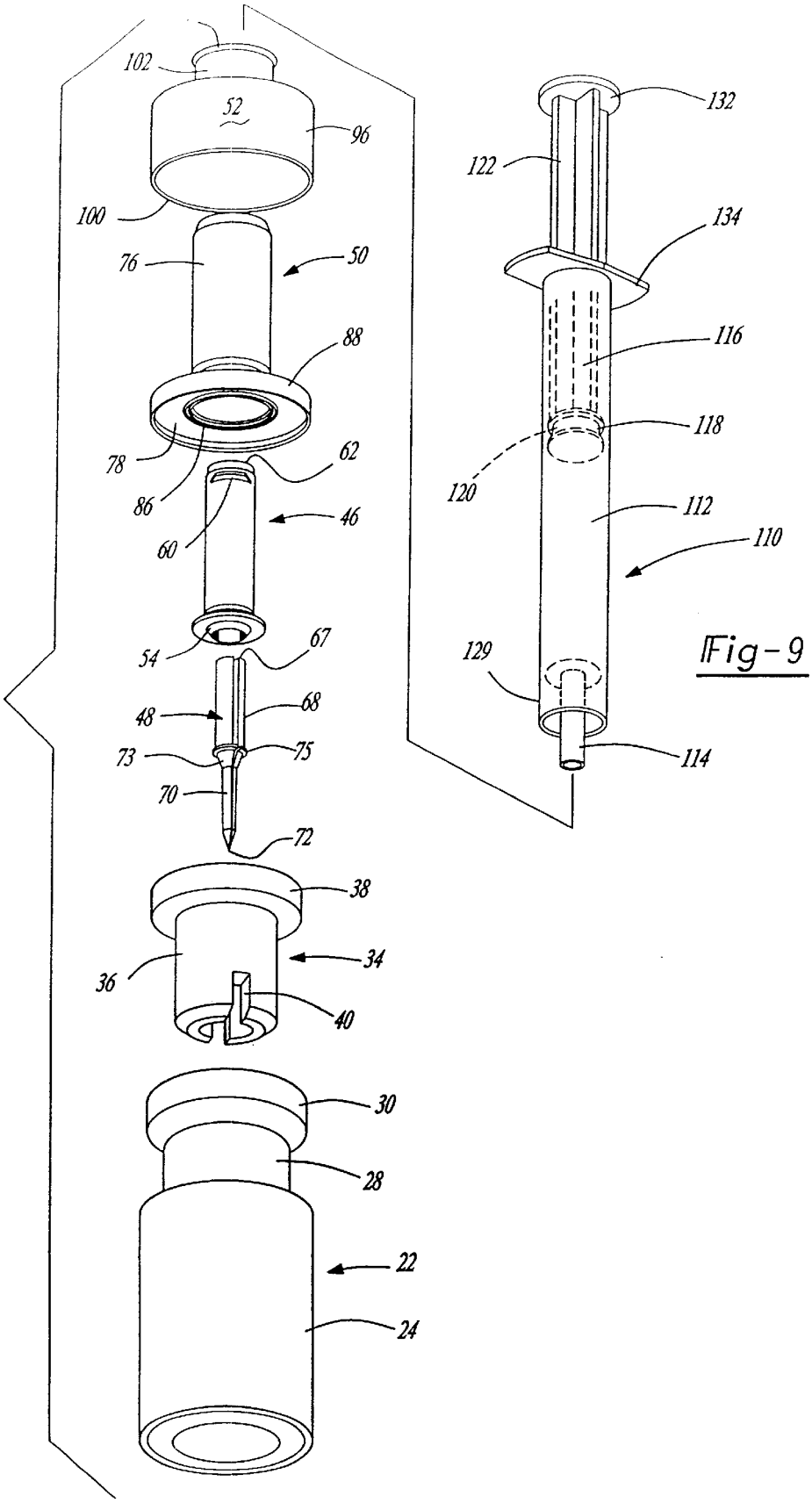
FIG. 9 is an exploded side elevation of the vial, transferset and syringe.
Figure 10:
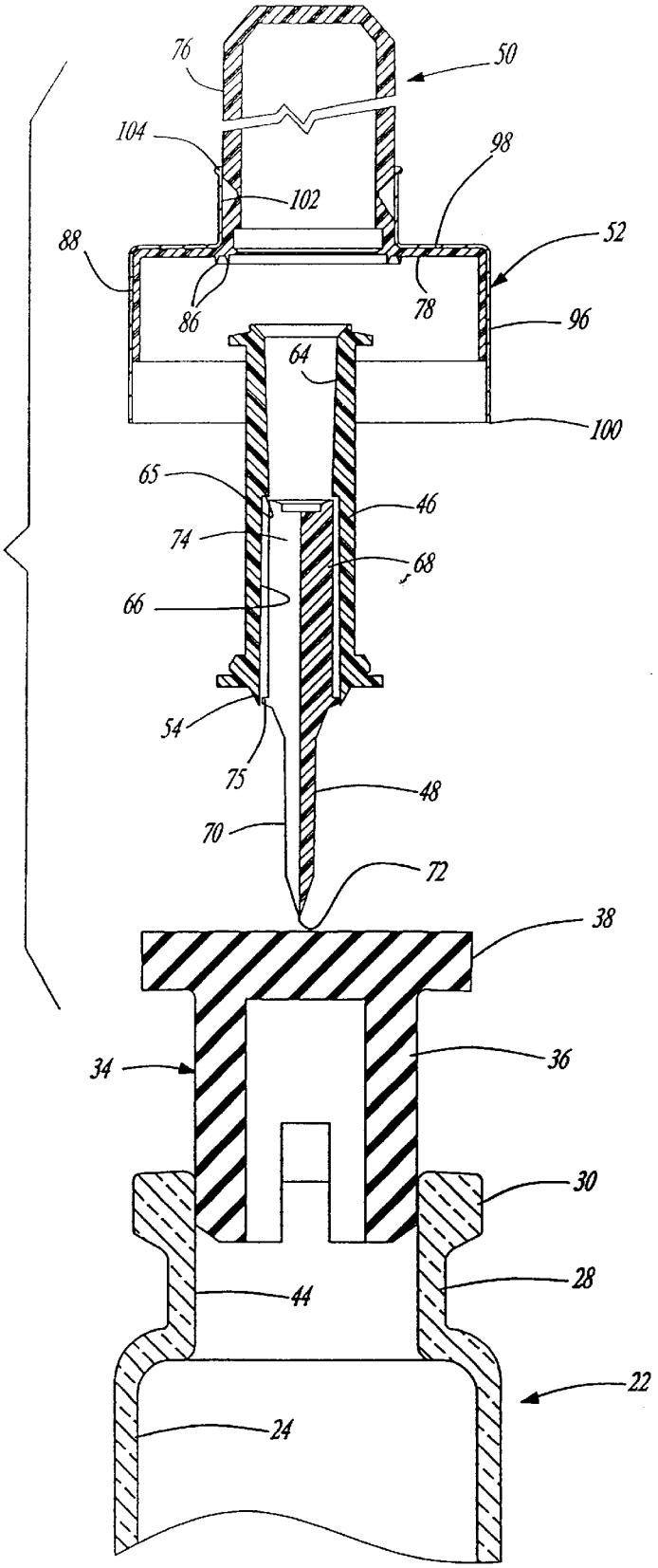
FIG. 10 is an exploded side view of the transferset, vial and stopper prior to assembly.

The method of assembling the transferset on a vial is best shown in FIGS. 9 and 10. The distal end 67 of the piercing member 48 is inserted into the proximate end of the tubular transfer member 46. As shown in FIG. 10, the barrel portion 68 of the piercing member is first received in the larger internal diameter 66, wherein the radial rib 75 is generally equal to the diameter of the internal surface 66. The barrel portion 68 of the piercing member is then received in the smaller diameter surface 64 until the radial rib 75 engages the radial surface 65 between the internal surfaces 66 and 64 (FIG. 10) as shown in FIG. 1. The distal ends 62 of the tubular transfer member and 67 of the piercing member are then received in the open proximate end of the cap 50 and the tubular portion 76 of the cap 50 is then received over the tubular portion 102 of the collar and the assembly is received over the radial planar rim portion 38 of the stopper 34 and the rim portion of the vial 22.

As noted above, the tubular transfer member 46 is accurately aligned within and supported by the cap 50. As shown in FIG. 2, the radial rib 90 of the tubular transfer member is received within the radial groove 92 of the cap 50 and the V-shaped rib 93 on the cap snaps into the mating V-shaped groove 94 in the tubular transfer member. Further, the outer longitudinal rim 88 on the cap is received over the radial planar portion 38 of the stopper, such that the entire transferset assembly is accurately aligned on the stopper 34. Further, the piercing member 48 is accurately aligned and supported within the tubular transfer member 46, such that the relatively sharp piercing end 72 extends beyond the proximate end of the tubular transfer member 46 and the piercing member 48 is able to move toward the stopper, but is restrained from withdrawing from the stopper by the radial rib 75. As shown in FIGS. 9 and 10, the distal open end 100 of the tubular portion 96 is initially coincident with the tubular portion 76 as shown in phantom in FIG. 1. Upon assembly, however, the end 100 is deformed or crimped into the neck portion 28 of the vial beneath the rim portion 30, permanently securing the transferset 20 on the vial 22. The radial rim portion 78 of the cap 50 is simultaneously compressed against the planar rim portion 38 of the resilient stopper as the distal end 100 of the collar 52 is crimped, such that the piercing end 72 of the piercing member 48 is pressed into the central portion 42 of the stopper, which causes the piercing end 72 to resiliently deform the unsupported central portion 42 of the stopper and, in the embodiment disclosed in FIGS. 1 to 4, the piercing end 72 may partially penetrate the central portion 42 of the stopper as shown in FIG. 2. As will be understood, it may not be desirable in some applications for the piercing end 72 of the piercing member to partially penetrate the central portion 42 of the stopper when the transferset is assembled on the vial, particularly where the vial and transferset assembly of this invention is to be stored for an extended period of time. In the alternative preferred embodiment of the transferset 320 shown in FIGS. 16 to 18, the piercing end 372 of the piercing member 348 is slightly rounded to avoid prepenetration of the stopper. Thus, the relative sharpness of the piercing end 72 and 372 of the piercing member 48 and 348 may be selected to either stretch or deform and prestress the central portion 42 of the planar rim portion 38 of the stopper 34 or deform and partially penetrate the central portion 42 of the stopper, as shown in FIGS. 1 to 4. Further, the sharpness of the pointed end 72 and 372 of the piercing member will depend upon the material used to form the piercing member 48 and the material may be selected to either partially pierce the stopper or simply deform and stretch the central portion 42 of the stopper.

The annular sealing lip 54 of the tubular transfer member 46 is also simultaneously driven into the central portion 42 of the stopper, stretching and prestressing the central portion 42 of the stopper as shown in FIG. 2, and the sealing lips 86 of the cap 50 are driven into the resilient stopper providing an additional seal encircling the sealing lip 54. In the most preferred embodiment, the sharp piercing edge 56 of the sealing lip 54 of the tubular transfer member 46 slightly penetrates the central portion 42 of the stopper, providing an improved seal surrounding the communication between the interior 32 of the vial 24 and the tubular transfer member 46 when the piercing member 48 fully penetrates the stopper 34 as now described.

The transferset and vial assembly shown in FIG. 1 is now ready for use. As set forth above, the transferset 20 may be assembled on the vial 22 and stopper 34 by the pharmaceutical company when the vial 22 is filled under sterile conditions. In a typical application, the vial is filled with a dry or powdered medicament which may be reconstituted into liquid form with an appropriate diluent or solvent solution prior to administration to a patient. In such applications, the diluent or solvent solution is first injected into the vial by a syringe, such as the conventional syringe 110 shown in FIGS. 4 to 6 and 9. A conventional syringe includes a tubular body portion 112, a tubular nozzle portion 114 which extends beyond the tubular body portion 112, a plunger 116 having a head portion 118 having external seals 120, such as the O-ring seals shown in FIGS. 4 to 6. The plunger shaft 122 is generally cruciform in shape and may be integral with the head 118. The plunger 116 may be driven through or reciprocate through the interior 128 of the tubular body portion 112 to eject or withdraw liquid through the nozzle portion 114. A collar portion or tubular extension 129 of the tubular body portion 112 extends beyond the distal portion of the nozzle 114, the interior surface of which includes a female Luer lock or female threads which are normally used to connect a needle to the syringe. As shown in FIG. 9, the shaft 122 of the plunger 116 generally includes a thumb or push button 132 and the body portion includes a radial, outwardly extending finger grip 134, such that the plunger head may be reciprocated through the tubular body portion 112 by gripping the radial finger grip 134 and the plunger head 118 is driven through the interior of the tubular body portion by engaging the push button 132 with the thumb. However, details of the design of various syringes are well known in the art and the transferset of this invention is not limited for use with any particular syringe design.

Figure 3:
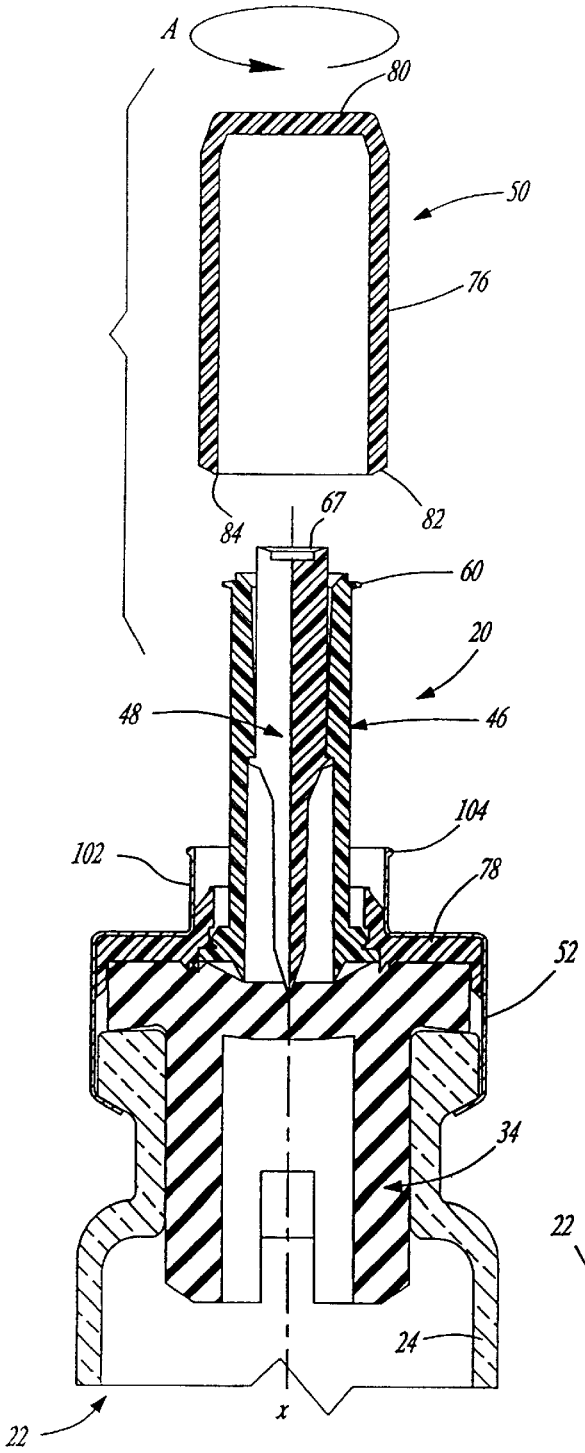
FIG. 3 is a partial side cross-sectional view of the vial and transferset assembly shown in FIG. 1 with the cover portion of the transferset removed.

Prior to use of the vial and transferset of this invention by a healthcare worker, for example, the cover portion of the cap 50 must first be removed as shown in FIG. 3. This is accomplished with the disclosed embodiment of the transferset 20 simply by twisting the distal end portion of the cap 50 as shown by arrow A in FIG. 3. This twisting motion breaks the frangible connection 84 formed by the radial groove 82. The cover portion then comprises the distal portion of the tubular portion 76 and the closed distal end portion 80 as shown in FIG. 3. The cover portion of the cap 50 is thus removed from the transferset 20 exposing the distal end 67 of the piercing member 48 and the tubular transfer member 46 as shown in FIG. 3. As described above, the distal tubular portion 102 of the collar includes a rounded bead 104 which protects the fingers of the healthcare worker during removal of the cover portion of the cap 50 which will now be more fully understood from FIG. 3.

Figure 4:
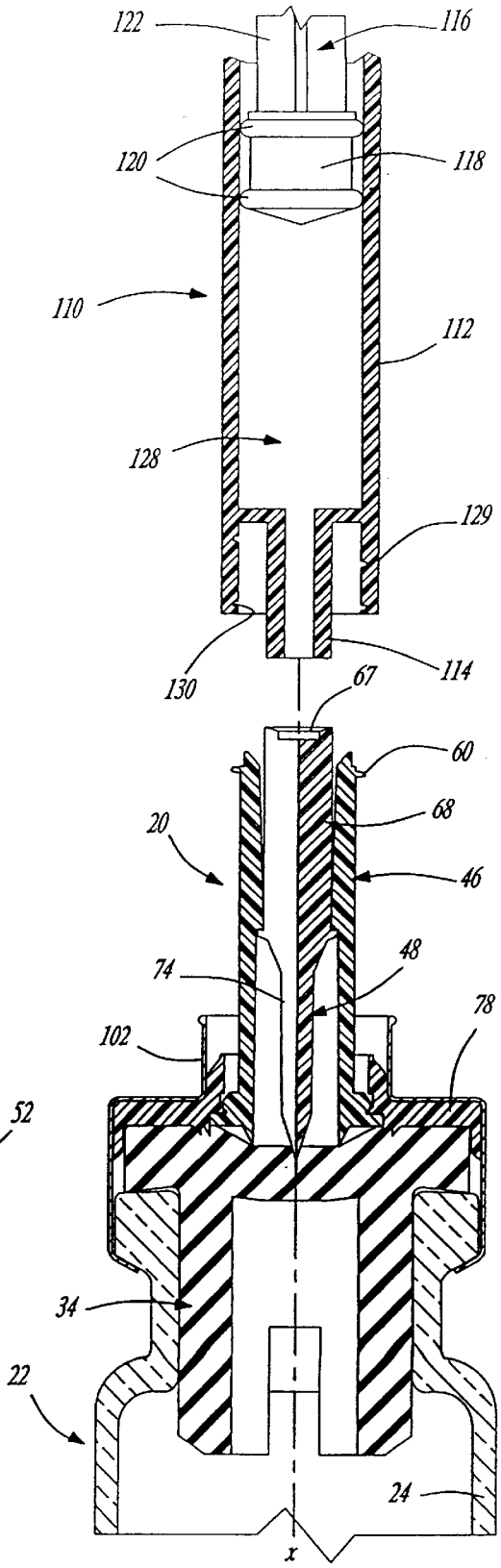
FIG. 4 is a partial cross-sectional view of the vial and transferset assembly as shown in FIG. 3 with a syringe oriented for connection to the transferset.

The transferset 20 with the cover portion of the cap 50 removed is now ready for receipt of an IV set or a conventional syringe 110 as shown in FIG. 4. First, the syringe 110 is coaxially aligned with the axis of the tubular transfer member 46. As shown, the diameter of the barrel portion 68 of the piercing member 48 is equal to or greater than the diameter of the nozzle portion 114 of the syringe, such that the nozzle portion 114 of the syringe will engage the distal end 67 of the piercing member 48.

Figure 5:
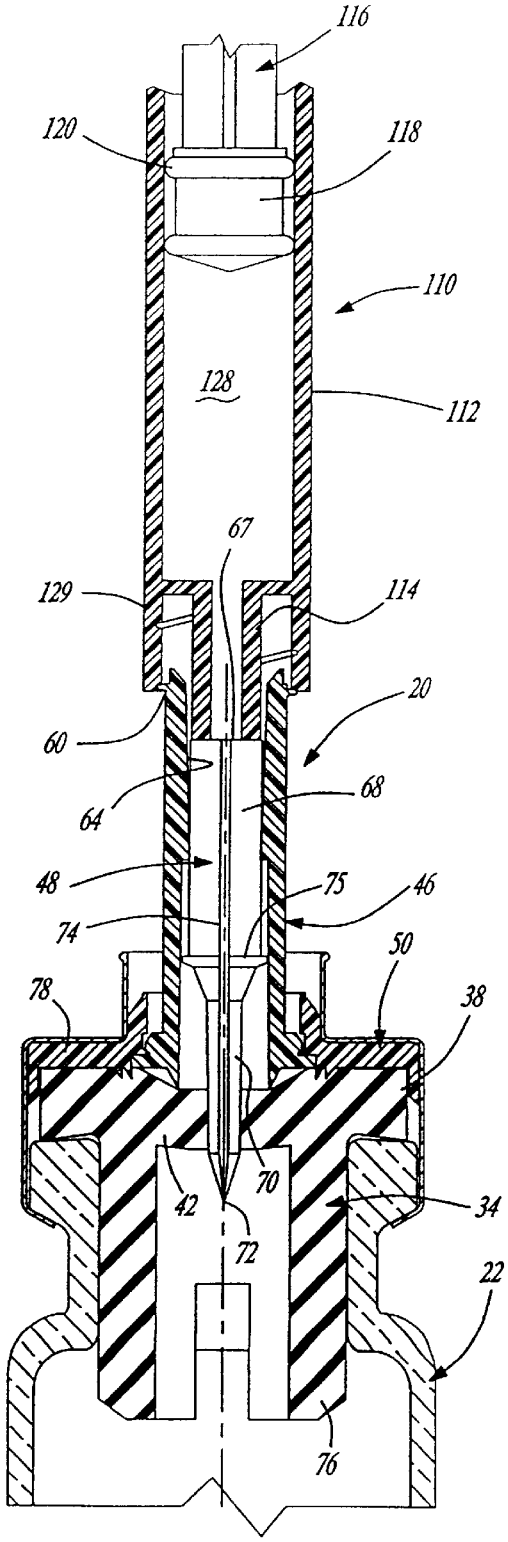
FIG. 5 is a partial side cross-sectional view of the vial and transferset assembly with the syringe ready for connection to the transferset.
Figure 6:
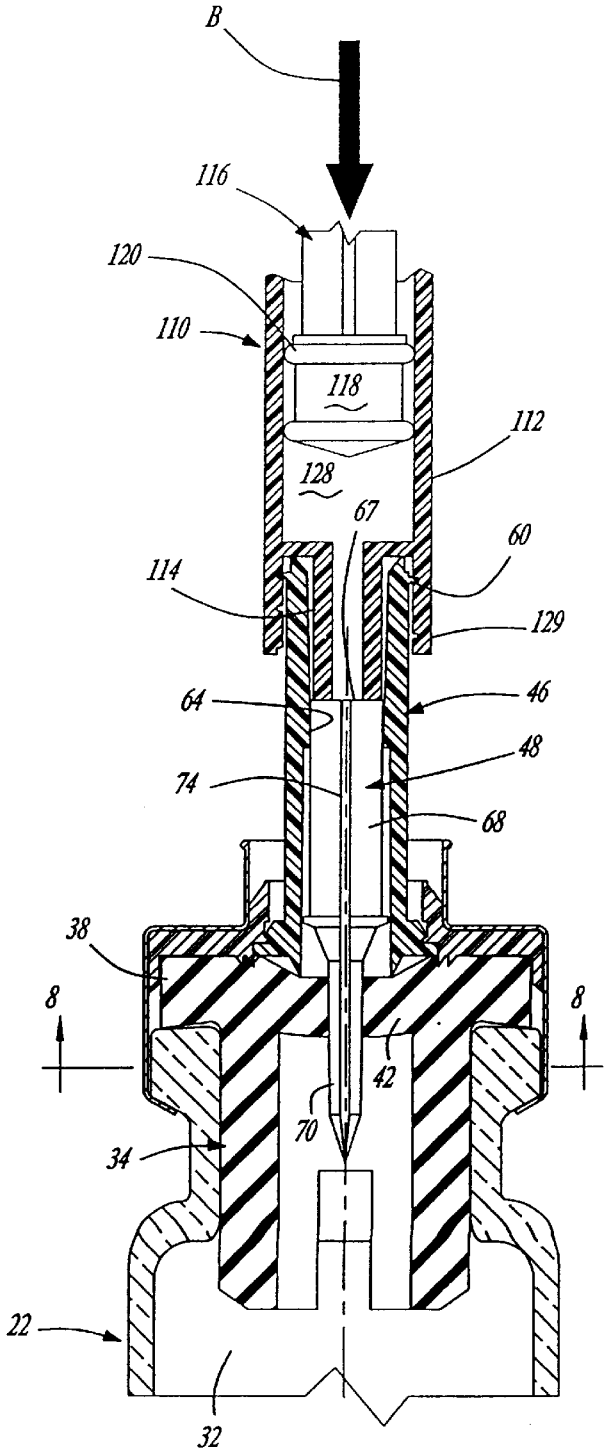
FIG. 6 is a partial side cross-sectional view of the vial, transferset and syringe with the syringe connected to the transferset and the plunger of the syringe moved to transmit liquid from the syringe to the vial.

The syringe 110 is then secured to the tubular transfer member 46 and the piercing portion 70 of the piercing member 48 is driven through the central portion 42 of the resilient stopper 34 as shown in FIGS. 5 and 6. As the tubular nozzle portion 114 of the syringe 110 is driven into the open distal end 64 of the tubular transfer member 46, the free end of the nozzle portion 114 is driven against the distal 67 of the piercing member 48, which drives the piercing end 72 through the central portion 42 of the stopper 34 as shown in FIG. 5. The reduced diameter piercing portion 70 of the piercing member 48 is then driven through the central portion 42 of the stopper by threading the male thread of the Luer lock 60 at the distal end of the tubular transfer member 46 into the female thread 130 of the Luer lock on the extension or collar 129 of the syringe as shown in FIG. 6. The threading of the syringe on the distal end of the tubular transfer member 46 drives the tubular nozzle portion 114 of the syringe 110 into the internal surface 64 of the tubular transfer member 46 and the free end of the tubular nozzle portion against the distal end 67 of the barrel portion 68 of the piercing member 48, which drives the piercing portion 70 of the piercing member through the central portion 42 of the stopper 34, establishing fluid communication through the external channel 74 and the interior 32 of the vial 22 as discussed more fully hereinbelow. As set forth above, the piercing of the center portion 42 of the stopper 34 by the piercing member 48 is facilitated by the circular sealing lip 54 on the proximate end of the tubular transfer member 46, which stretches and prestresses the unsupported central portion 42 of the stopper which overlies the tubular portion 36.

Figure 8:
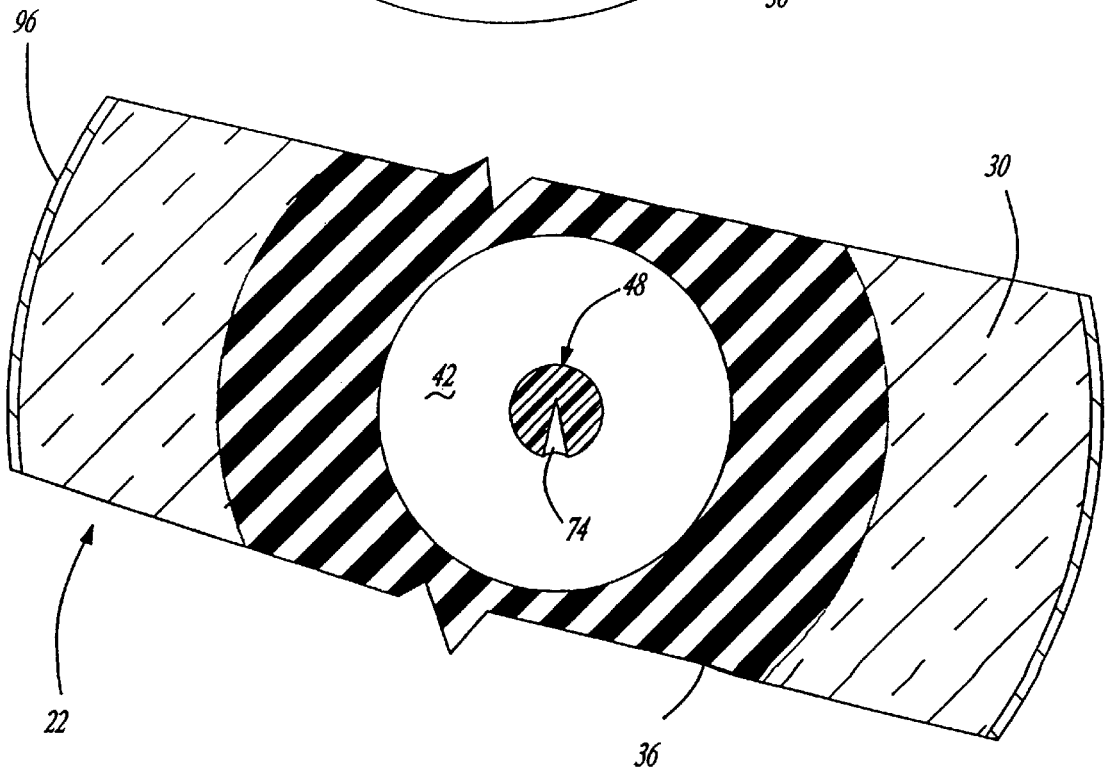
FIG. 8 is a top cross-sectional view of FIG. 6 in the direction of view arrows 8—8.

In a typical application of the transferset 20 of this invention, wherein the vial 22 contains a drug or medicament in dry or powdered form which is reconstituted by a diluent or solvent solution in the interior 128 of the syringe, the liquid diluent or solvent may now be transferred to the interior of the vial 22 simply by depressing the plunger 116 of the vial 110 as shown by arrow B in FIG. 6. The liquid in the interior 128 of the syringe is thus ejected through the tubular nozzle portion 114 into the external channel 74 of the piercing member 48 into the tubular portion 34 of the stopper and thus into the interior 32 of the vial 22. As shown in FIG. 8, which is a cross-section through the rim of the vial as shown in FIG. 6, one configuration of the generally longitudinal channel 74 in the piercing member 48 is a V-shaped channel 74 which is relatively simple to manufacture. Further, the use of a V-shaped channel having an angle of about 15° to 60° does not materially weaken the piercing member and provides adequate communication between the interior 32 of the vial and the tubular transfer member 46 through the channel 74. A larger angle of about 45° to 60° may be preferred to limit manufacturing problems and avoid potential blockage of the groove. Further, the channel 74 may be of any convenient shape, including rectangular. As shown in FIG. 8, the resilient elastomeric central rim portion 42 of the stopper will be deformed into and partially fill the channel 74 in the piercing member when the piercing portion 70 penetrates the stopper. The deformation and stretching of the central portion 42 of the stopper over the opening of the vial by the sealing lip 54 of the tubular transfer member however reduces the volume of elastomeric material which is deformed into the channel 74, thereby improving fluid communication through the external channel 74.

Figure 7:
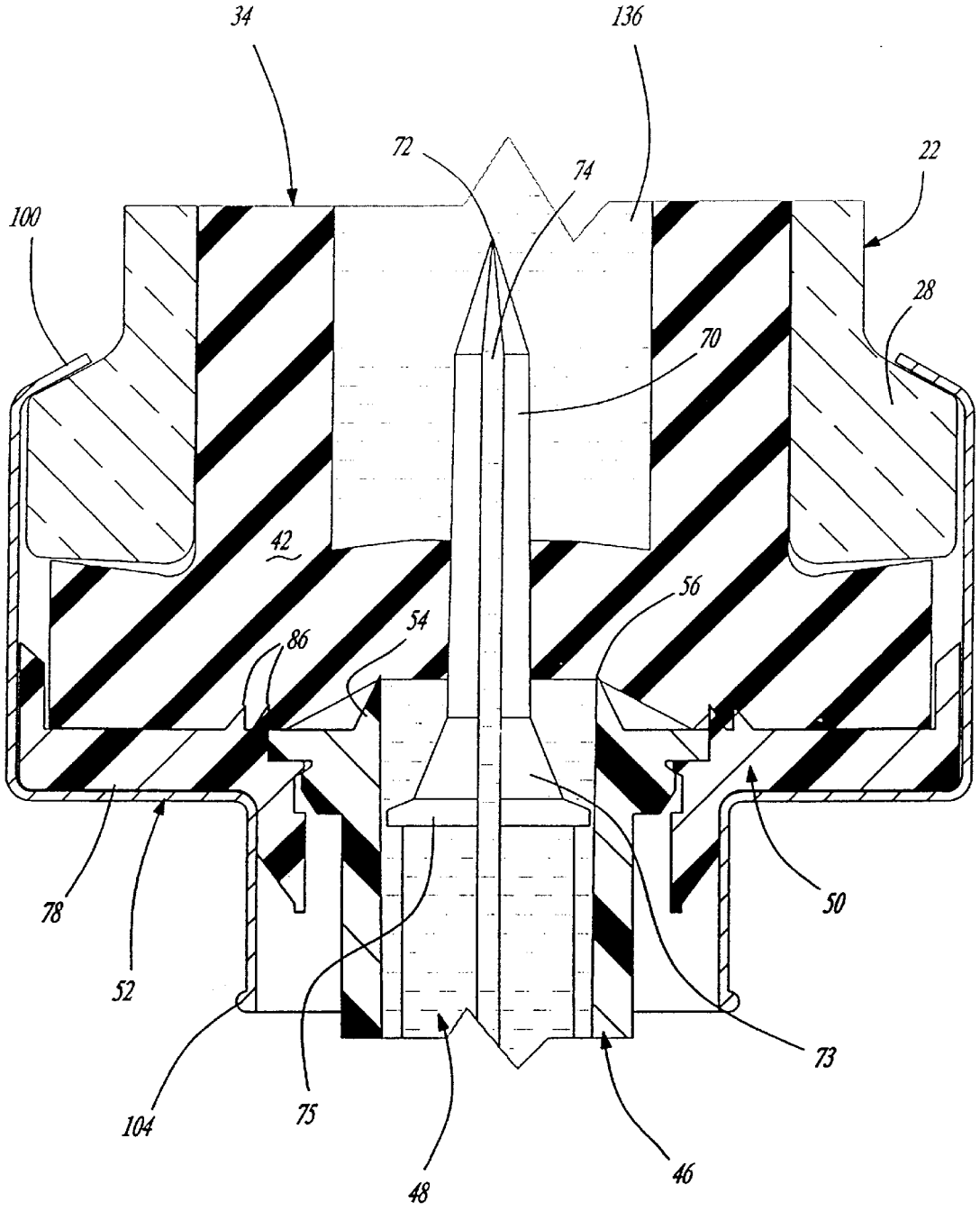
FIG. 7 is an enlarged side-cross sectional view of FIG. 6 illustrating the fluid communication between the vial and the transferset.

Generally, the liquid medicament is fully reconstituted by shaking the assembly as shown in FIG. 7. The liquid medicament 136 may then be reaspirated into the same or a different syringe simply by withdrawing the plunger 116 into the tubular body portion 112 in the opposite direction from arrow B in FIG. 6. It is important to note from FIG. 7 that the liquid medicament 136 is transferred from the vial 122 through the external channel 74, then from the external channel into the tubular transfer member 46 to the syringe (not shown). This should be contrasted with a needle having a small internal lumen or bore, wherein the liquid medicament below the piercing end (72 of the piercing member 48) cannot be reaspirated because the liquid must be transferred through the lumen of the needle. It should also be noted that the sharp end 56 of the annular or circular sealing lip 54 seals the communication between the tubular transfer member and the external channel 74 of the piercing member 48. This embodiment of the tubular transferset 20 of this invention and method of assembly thus provides several important advantages over the prior art as described above.

FIGS. 11 to 15 illustrate an alternative embodiment of the vial transferset and method of this invention, wherein the fluid pressure in the syringe is utilized to drive the piercing member through the central portion of the stopper rather than mechanical force as described above in regard to FIGS. 1 to 10. The components of the transferset 220 have been numbered in the same sequence as the transferset 20 shown in FIGS. 1 to 10, except that the components of the transferset 220 are numbered in the 200 series for ease of description and reference to FIGS. 1 to 10 described above. The vial 22, stopper 34 and syringe 110 may, however, be identical to the same components described above and are therefore numbered the same.

Figure 11:
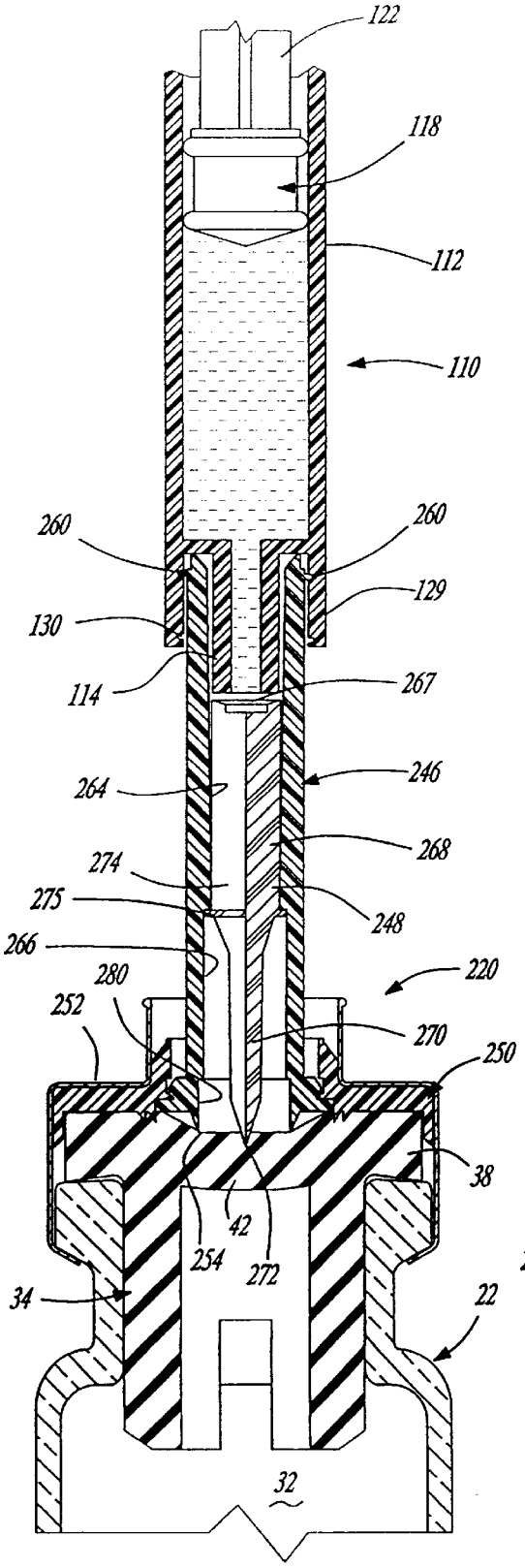
FIG. 11 is an enlarged side-mass sectional view of a second embodiment of a transferset and vial assembly.
Figure 12:
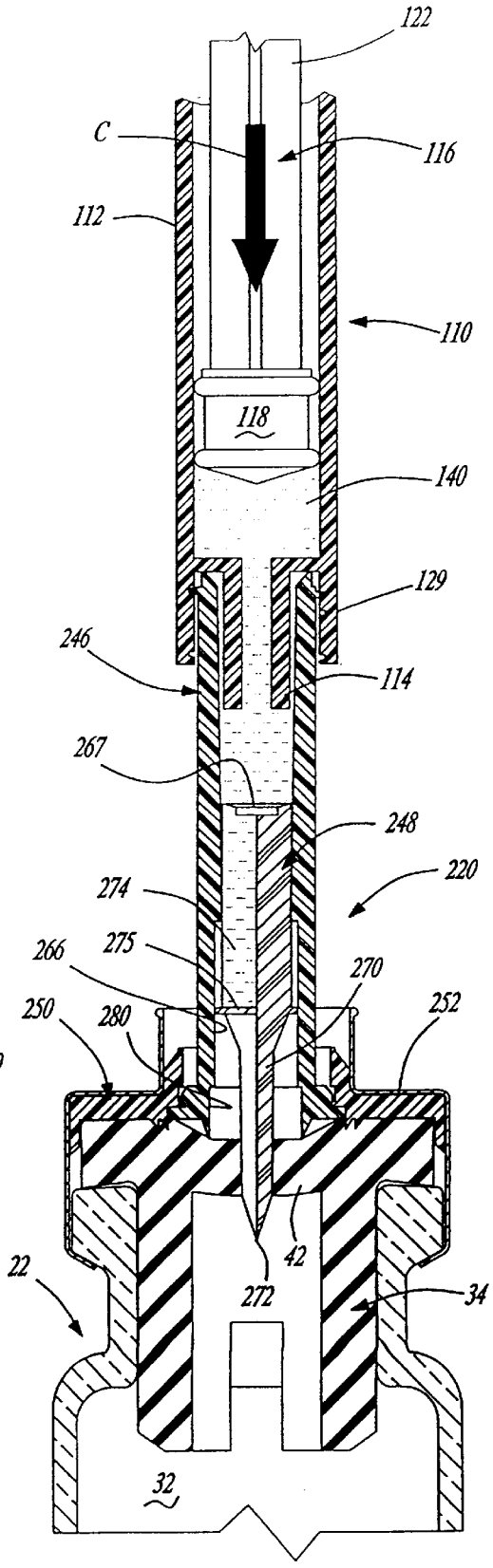
FIG. 12 is a side cross-sectional view of the vial and transferset of FIG. 11 illustrating piercing of the vial stopper.
Figure 13:
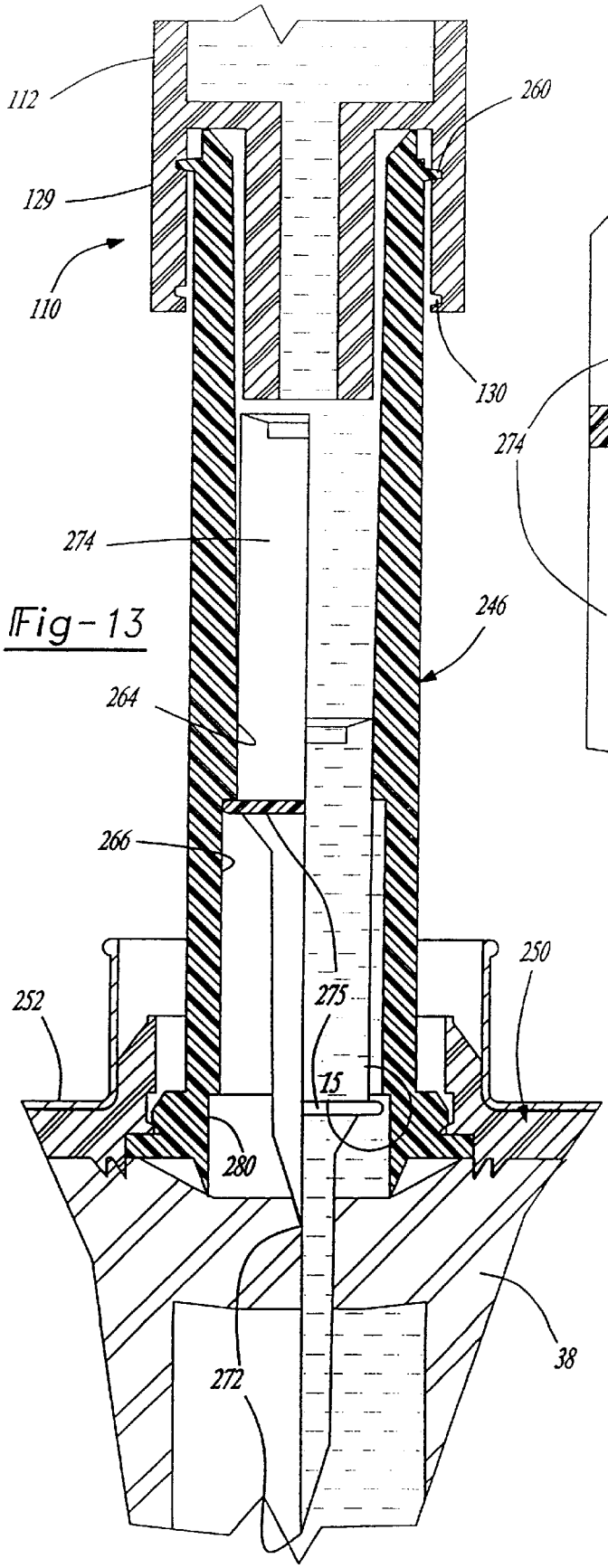
FIG. 13 is a partial side cross-sectional view of the vial and transfer set of FIGS. 11 and 12 illustrating the flow of fluid from the syringe to the vial.

In the transferset 220 shown in FIGS. 11 to 15, the tubular transfer member 246 has an axial length which is greater than the axial length of the piercing member 248, such that the distal end 267 of the piercing member is recessed in the smaller diameter opening 264 of the tubular transfer member a distance equal to or greater than the length of the tubular nozzle 114 of the syringe 110. This can be accomplished either by reducing the axial length of the piercing member 248 or increasing the length of the tubular transfer member 246 as shown in FIGS. 11 to 15. Thus, in this embodiment, when the male Luer lock connection 260 on the tubular transfer member 246 is threaded into the female threads of the Luer lock of the tubular extension 129, the tubular extension is received within the internal surface 264 of the tubular transfer member 246 without engaging the distal end 267 of the piercing member 248 as shown in FIG. 11. This somewhat simplifies the connection of the syringe 110 to the tubular transfer member 246 compared to the embodiment of the transferset 20 shown in FIGS. 1 to 10 because the healthcare worker is not required to pierce the vial by urging the tubular nozzle portion 114 of the syringe against the distal end 267 of the piercing member although the embodiment of the transferset 20 is relatively easy to assemble.

Figure 15:
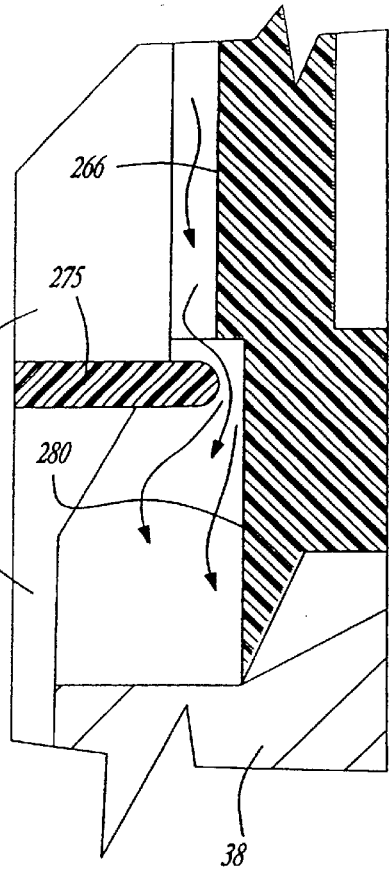
FIG. 15 is an enlarged view of the encircled portion 15 of FIG. 13.
Figure 14:
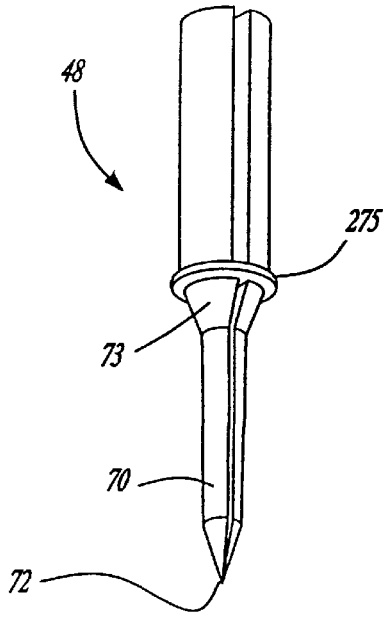
FIG. 14 is a perspective view of the piercing member utilized in the transferset shown in FIGS. 11 to 13.

The piercing end 272 of the piercing member 248 is then driven through the center portion 42 of the stopper 34 by moving the head 118 of the plunger 116 of syringe 110 toward the nozzle 114 of the syringe, which drives the liquid 140 in the tubular body portion 112 of the syringe against the radial rib 275 of the piercing member 248. As best shown in FIG. 14, the radial rib 275 on the piercing member 248 of the transferset 220 shown in FIGS. 11 to 15 provides a fluid seal. That is, the radial sealing rim 275 extends into the external generally longitudinal channel 274 and the radial sealing rib 275 has an external diameter generally equal to or slightly greater than the internal diameter of the internal cylindrical surface 266 of the tubular transfer member 46. In this embodiment, the tubular transfer member includes a second enlarged bore 280 adjacent the proximate end having an internal diameter greater than the external diameter of the radial sealing rib 275. Thus, when the fluid pressure created by the plunger 118 of the syringe 110 drives the radial sealing rib 275 into the enlarged diameter portion 280, fluid is permitted to flow around the radial sealing rib 275 into the proximal portion of the channel 274 in the piercing member which has penetrated the central portion 42 of the stopper as shown in FIG. 15.

Figure 16:
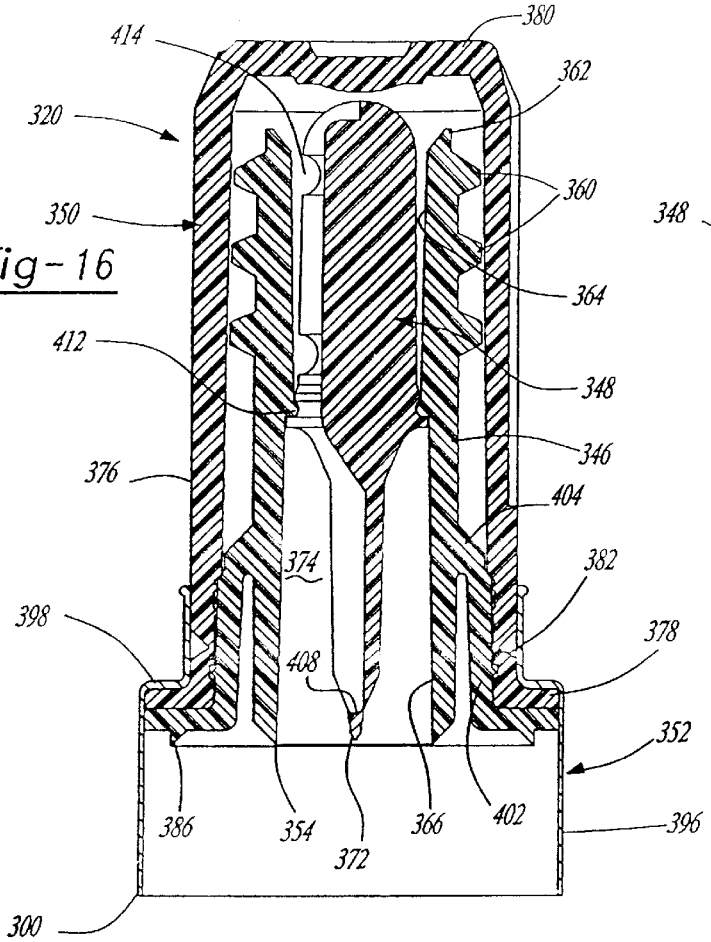
FIG. 16 is a side partially cross-sectioned view of an alternative preferred embodiment of the transferset of this invention.
Figure 17:
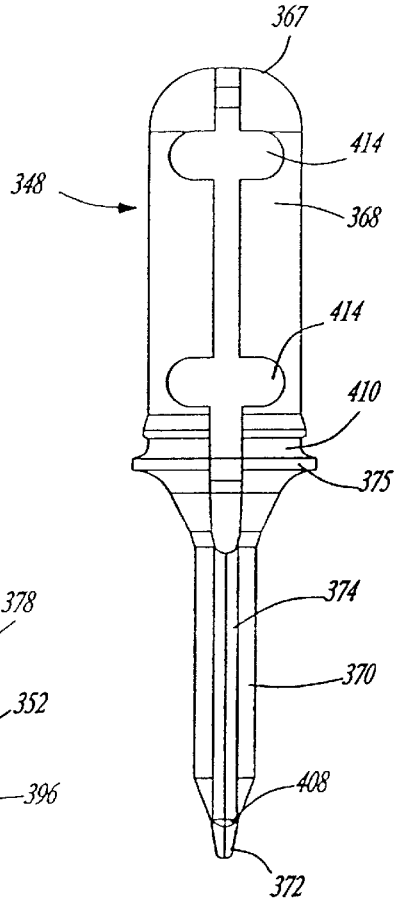
FIG. 17 is a side elevation of the piercing member shown in FIG. 16.
Figure 18:
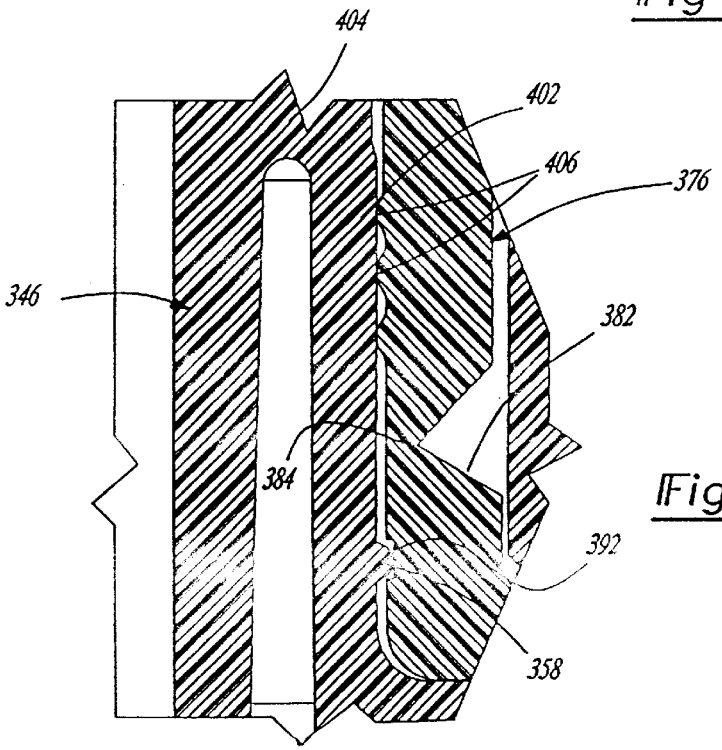
FIG. 18 is an enlarged fragmentary side cross-sectional view of FIG. 16 illustrating the interconnection between the tubular transfer member and the cap of this embodiment.

The preferred alternative embodiment of the transferset 320 shown in FIGS. 16 to 18 operates and is assembled in the same manner as the embodiment of the transferset 20 shown in FIGS. 1 to 10. Further, the components of the transferset 320 are generally the same, including a tubular transfer member 346, a piercing member 348, a generally cupshaped cap 350 and a collar member 352. Thus, the components of the transferset 320 are numbered in the same sequence as the components of the transferset 20 shown in FIGS. 1 to 10 except that the components of the embodiment of the transferset 320 shown in FIGS. 16 to 18 are numbered in the 300 series. Where appropriate, the features of the components are also numbered in the same sequence for ease of reference to the above description and to avoid duplication of the description of this embodiment. Thus, for example, the tubular transfer member 346 includes an annular or circular sealing lip 354, a Luer lock connector 360 at its distal end, a first smaller internal diameter 364 and a larger proximate internal diameter 366 as described above. The following description of the components of the transferset 320 shown in FIGS. 16 to 18 will therefore be limited to the features which differ from the features of the transferset 20 shown in FIGS. 1 to 10.

First, as best shown in FIG. 18, the tubular transfer member 346 includes an integral generally tubular connector portion 402, which in this embodiment, surrounds the proximate end of the tubular transfer member and is integrally joined to the remainder of the tubular transfer member at 404. The external surface of the connector portion 402 includes a radially projecting rounded rib 358 which is received in a groove 392 formed in the inner wall of the cap, providing a simplified snap-in interlock between the tubular transfer member 346 and the cap 350. The threaded Luer connector 360 on the tubular transfer member is also slightly modified; however, the Luer connector 360 is also conventional. The inner wall of the tubular portion 376 of the cap 350 also includes a plurality of sealing ribs 406 in this embodiment which engage the outer wall of the connector portion 402 of the tubular transfer member 346 which seal the connection between the cap and the tubular transfer member and prevent contamination of the transferset.

The piercing member 348 has also been modified in this embodiment. First, as best shown in FIG. 17, the piercing end 372 of the piercing member 348 is slightly rounded to prevent premature penetration of the planar rim portion 38 of the stopper 34 shown, for example, in FIG. 1. That is, the slightly rounded ,piercing end 372 will deform and stretch the planar rim portion 38 of the stopper, but will not partially penetrate the rim portion as shown in FIG. 1. The piercing end 372, however, is "relatively sharp" and will pierce the planar rim portion of the elastomeric stopper 34 when the piercing member 348 is driven into the stopper as described above. Further, the external channel 374 in the piercing member 348 terminates short of the piercing end as shown in FIG. 17, such that the channel 374 includes a rounded end wall 408 spaced slightly from the proximate end of the relatively sharp piercing end 372. Terminating the external channel 374 a few millimeters (e.g. 7 mm) short of the piercing end 372 strengthens the piercing end 372 for penetration of the planar rim portion 38 of the stopper. In this embodiment, the piercing member 348 is releasably retained in the tubular transfer member by an interlocking rib and groove as best shown in FIGS. 16 and 17. In the disclosed embodiment, the piercing member includes an arcuate groove 410 adjacent the radial rib 375 and the internal surface 364 of the tubular transfer member 346 includes an interlocking arcuate rib 412 as shown in FIG. 16 which releasably retains the piercing member 348 in the tubular transfer member 346. In the disclosed embodiment of the piercing member 348, the barrel portion includes two spaced flats 414 which receive the mold ejector pins (not shown) which make it easier to remove the piercing member from the mold, but the flats do not form a functional part of the invention. Thus, as described above, the transferset 320 shown in FIGS. 16 may be preassembled in bulk with the collar for distribution to pharmaceutical companies, for example, for attachment to a vial under sterile conditions. The barrel portion 368 of the tubular transfer member further includes spaced flats which receive ejector pins in a mold to simplify release of the piercing member 348 from the mold, but are not functional in the transferset assembly 320. Finally, in this embodiment, the distal end 367 of the piercing member 348 is rounded which also simplifies molding of the piercing member 348.

The components of the transferset 328 are assembled and secured to a vial 22 as described above. Upon assembly of the transferset 320 as shown in FIG. 16, the end 300 of the tubular portion 396 is crimped into the reduced diameter neck portion 28 of the vial as described above. The assembly of the transferset 320 on the vial drive the sealing lips 354 and 386 of the tubular transfer member into the planar radial rim portion 38 of the stopper, sealing the assembly. The cover portion of the cap 350 is then removed by twisting the distal end, breaking the frangible connection 384 as described. The transferset may then be utilized to transfer fluid to or from the vial by connecting a syringe 110 or IV set (not shown) to the Luer lock connector 360 as described above. As set forth above, the operation of the transferset 320 in transferring fluid to or from a vial is the same as described above in regard to FIGS. 1 to 10.

As will be understood by those skilled in the art, various modifications may be made to the vial transferset and method of this invention within the purview of the appended claims. For example, the tubular transfer member 46, 246 and 346 may be polygonal, in which case, the barrel portion 68, 268 and 368 of the piercing member 48, 248 and 348 may be similarly polygonal and the tubular portion 76, 276 and 376 of the cap may either by cylindrical or polygonal. Further, the collar 52, 252 and 352 may be formed of any suitable malleable material or may also be formed of a suitable plastic although in the disclosed embodiment the collar may be formed of aluminum. The piercing member and tubular transfer member may be formed of various materials including, for example, a medical grade polycarbonate having the appropriate strength and suitable for sterilization. The cap 50, 250 and 350 may also be formed of a medical grade polycarbonate. Further, as set forth above, the external generally longitudinal channel 74, 274 and 374 in the piercing member 48, 248 and 348 respectively, may be of various configuration including, for example, a spiral or a discontinuous longitudinal groove. Having described the vial transferset and method of this invention, it is now claimed as set forth below.

What is claimed is:

1. A fluid transfer assembly for establishing fluid communication between a syringe or the like and a sealed vial, said vial having an open end, a rim surrounding said open end, a reduced diameter neck portion adjacent said rim and a pierceable stopper received in and sealing said vial open end, said stopper having a rim portion received over said vial rim, said transfer assembly comprising:

a tubular transfer member having an open proximate end sealingly supported on said stopper rim portion in alignment with said vial open end and an open distal end adapted to receive a syringe tip in sealed communication;

a piercing member received within said tubular transfer member reciprocally supported by an internal surface of said transfer member, said piercing member having a piercing end opposite said stopper rim portion adapted to pierce said stopper and an opposed distal end;

a cap having a proximate radial rim portion adjacent an open end, a tubular portion surrounding said tubular transfer member and a closed distal end enclosing said open distal end of said transfer member and said distal end of said piercing member;

a collar having a radial portion received over said cap radial rim portion, a tubular portion surrounding said cap radial rim portion and said vial rim and a distal radial portion received in said vial neck portion of said vial beneath said vial rim permanently securing said transfer assembly to said vial, and said cap having a frangible portion located beneath said collar spaced from said closed distal end portion of said cap.

2. The fluid transfer assembly defined in claim 1, wherein said piercing member includes an external generally longitudinal channel providing communication between said vial open end and said tubular transfer member when said piercing member pierces said stopper.

3. The fluid transfer assembly defined in claim 1, wherein said piercing member piercing end extends beyond said tubular transfer member and said piercing member is releasably restrained in said tubular transfer member with said sharp piercing end partially penetrating said stopper.

4. The fluid transfer assembly defined in claim 1, wherein said tangible portion of said cap comprises a radial groove weakening the wall of said tubular portion for removal of said closed distal end from said fluid transfer assembly prior to use.

5. The fluid transfer assembly defined in claim 1, wherein said collar includes a distal tubular portion surrounding said radial groove.

6. The fluid transfer assembly defined in claim 1, wherein said radial rim portion of said tubular transfer member includes a projecting circular sealing lip surrounding said tubular portion of said transfer member which engages said stopper rim portion, deforming and stretching said stopper rim portion over said vial open end, sealing the communication between said vial open end and said tubular transfer member when said piercing member pierces said stopper.

7. The fluid transfer assembly defined in claim 6, wherein said circular lip of said transfer member extends generally perpendicular to said radial rim portion of said transfer member and includes a pointed edge which bites into said rim portion of said stopper.

8. The fluid transfer assembly defined in claim 6, wherein said radial rim portion of said cap includes a circular sealing lip surrounding said tubular portion of said cap which engages said stopper rim portion in sealed relation providing a seal to maintain the sterility of said fluid transfer assembly when assembled on said vial.

9. The fluid transfer assembly defined in claim 1, wherein said piercing member distal end is cylindrical having an external diameter generally equal to an internal surface of said tubular transfer member adjacent said distal end of said transfer member supporting said piercing member generally perpendicular to said rim portion of said stopper.

10. The fluid transfer assembly defined in claim 1, wherein said piercing member includes a radial lip received in an enlarged counter bore in said tubular transfer member which releasably retains said piercing member in said tubular transfer member with said sharp piercing end partially penetrating said stopper prior to use.

11. The fluid transfer assembly defined in claim 1, wherein said tubular transfer member proximate end includes a radial flange which interlocks with said cap.

12. The fluid transfer assembly defined in claim 1, wherein said collar is formed of a relatively thin malleable metal and said tubular portion is crimped into said vial neck beneath said vial rim permanently securing said transfer assembly to said vial.

13. A fluid transfer assembly for establishing fluid communication between a syringe and a sealed vial, said vial having an open end, a rim surrounding said open end, a reduced diameter neck adjacent said rim, and a pierceable stopper received in and sealing said vial open end, said stopper having a rim portion received over said vial rim, said transfer assembly comprising:

a generally tubular transfer member having an open proximate end sealingly supported on said stopper rim in generally coaxial alignment with said vial open end and an open distal end adapted to receive a syringe in sealed communication;

a piercing member received within said tubular transfer member reciprocally supported by an internal surface of said transfer member, said piercing member being generally cylindrical and having a relatively sharp piercing end deforming said stopper radial rim portion and an external channel providing communication between said vial and said tubular transfer member when said piercing member penetrates said stopper;

a cup-shaped cap having a tubular portion surrounding said transfer member and a removable cover portion enclosing said open distal end of said transfer member and said distal end of said piercing member; and a collar having a radial portion received over said cap radial rim portion, a tubular portion surrounding said cap radial rim portion and said vial rim and a distal radial portion received in said vial neck portion beneath said vial rim permanently securing said transfer assembly to said vial.

14. The fluid transfer assembly defined in claim 13, wherein said collar is formed of a relatively thin malleable material and said distal radial portion of said collar is crimped in said vial neck of said vial beneath said vial rim permanently securing said transfer assembly to said vial.

15. The fluid transfer assembly defined in claim 13, wherein said tubular portion of said cap includes a radial groove weakening the wall of said tubular portion for removal of said cover portion prior to use.

16. The fluid transfer assembly defined in claim 14, wherein said open distal end of said tubular transfer member includes an external Luer connector for receipt of a Luer connector of said syringe.

17. The fluid transfer assembly defined in claim 14, wherein said radial rim portion of said tubular transfer member includes a projecting circular sealing lip surrounding said tubular portion of said transfer member which engages said stopper rim portion, said projecting lip portion stretching said rim portion of said stopper over said vial open end sealing the communication between said vial open end and said tubular transfer member when said piercing member pierces said stopper and reducing deformation of stopper material into said piercing member external channel, thereby improving fluid communication through said channel.

18. The fluid transfer assembly defined in claim 14, wherein said circular sealing lip of said transfer member includes a pointed edge which bites into said rim portion of said stopper, whereby said tubular fluid transfer member is sealingly supported on said stopper rim portion.

19. The fluid transfer assembly defined in claim 18, wherein said radial rim portion of said cap includes a circular sealing lip which surrounds said tubular portion of said cap, said sealing lip of said cap engaging said stopper rim portion in sealed retention providing a seal for maintaining sterility of the interior of said fluid transfer assembly.

20. A method of transferring fluid medicament between a conventional sealed vial and a second container, said vial having an open end, a rim surrounding said open end, a reduced diameter neck adjacent said rim and a pierceable stopper received in and sealing said vial open end, said stopper having a rim portion received over said vial rim, said second container including a tubular connector portion, said method comprising:

mounting a fluid transfer assembly on said vial, said transfer assembly including a generally tubular transfer member having an open proximate end adapted to be sealingly supported on said stopper rim of said vial in alignment with said vial open end and an open distal end having a connector adapted to be connected to said connector portion of said second container, a generally cylindrical piercing member received in said tubular transfer member reciprocally supported by an internal surface of said tubular transfer member, said piercing member having a generally sharp piercing end and an external channel, and a tubular collar, said method including mounting said fluid transfer assembly on said vial by securing said collar on said neck portion of said vial beneath said rim with said tubular transfer member sealingly engaging said stopper rim portion and said piercing member coaxially aligned with said vial open end and said piercing end adjacent said stopper;

attaching said connector portion of said second container to said connector on said tubular transfer member, driving said piercing member generally sharp piercing end through said stopper rim portion, said external channel in said piercing member establishing fluid communication between said vial and said second container through said tubular transfer member, thereby permitting transfer of fluid from said second container to said vial or from said vial to said second container.

21. The method of transferring fluid medicament between a conventional sealed vial and a second container as defined in claim 20, wherein said fluid transfer assembly includes a cup-shaped cap having a radial rim portion adjacent an open end, said method including mounting said cap with said rim portion opposite said stopper radial rim portion, a tubular portion surrounding said transfer member and a cover portion enclosing said open distal end of said transfer member and said distal end of said piercing member, said cover portion attached to said cap by a frangible connector, said method including mounting said fluid transfer assembly on said vial under sterile conditions with said cup-shaped cap enclosing said transfer assembly maintaining said tubular transfer member and said piercing member under sterile conditions until use, then removing said cover portion by breaking said frangible connector, then attaching said syringe to said tubular transfer member.

22. The method of transferring fluid medicament between a conventional sealed vial and a second container as defined in claim 21, wherein said collar is formed of a relatively thin malleable metal having a tubular portion and a radial portion, said method including telescopically receiving said collar over the components of said fluid transfer assembly and said vial rim with said radial portion overlying said components of said transfer assembly and said tubular portion receiving said vial rim, then crimping a free end of said tubular portion beneath said vial rim extending into said vial neck permanently securing said transfer assembly on said vial.

23. The method of transferring fluid medicament between a conventional sealed vial and a second member as defined in claim 21, wherein said tubular transfer member includes a generally circular sealing lip surrounding said tubular portion of said transfer member which is generally aligned with said tubular portion, said method including compressing said sealing lip against said rim portion of said stopper as said collar is crimped on said vial, stretching said rim portion of said stopper before piercing of said stopper by said piercing member.

24. The method of transferring fluid medicament between a conventional sealed vial and a second member as defined in claim 23,, wherein said circular sealing lip of said tubular transfer member has a pointed edge, wherein said method includes pressing said sealing lip against said rim portion of said stopper, such that said sealing lip pointed edge bites into said stopper rim portion providing an improved seal of the communication between said vial open end and said tubular transfer member when said piercing member pierces said stopper.

25. The method of transferring fluid medicament between a conventional sealed vial and a second container as defined in claim 23, wherein said piercing member is releasably retained in said tubular transfer member with said piercing end extending beyond said tubular transfer member, said method including compressing said sealing lip of said tubular transfer member and said piercing end of said piercing member against said rim portion of said stopper as said collar is crimped on said vial, said piercing end of said piercing member resiliently deforming said rim portion of said stopper.

26. The method of transferring fluid medicament between a conventional sealed vial and a second container as defined in claim 20, wherein said connector on said tubular transfer member and said connector portion of said second container are mating threaded connectors and said connector portion of said second container extends beyond a body portion of said second container, said method including threading said threaded connector portion of said second container on said threaded connector of said tubular transfer member thereby driving said nozzle portion of said syringe against said distal end of said piercing member and said sharp end of said piercing member through said stopper rim portion, thereby establishing said fluid communication between said second container and said vial.

27. The method of transferring fluid medicament between a conventional sealed vial and a second container as defined in claim 21, wherein said second container is a syringe having a tubular body portion initially filled with fluid, a plunger retracted within said syringe tubular body portion, and a reduced diameter tubular nozzle portion extending beyond said tubular body portion, said piercing member including a radial sealing portion engaging an interior surface of said tubular transfer member, said method including attaching said syringe on said connector on said tubular transfer member thereby establishing fluid communication between said nozzle portion of said syringe and said distal end of said tubular transfer member, then driving said plunger of said syringe toward said nozzle portion, driving fluid against said radial sealing portion of said piercing member and driving said piercing end of said piercing member through said stopper, thereby establishing said communication between said syringe and said vial.

28. The method of transferring fluid medicament between a conventional sealed vial and a second container as defined in claim 21, wherein said fluid transfer assembly includes a cup-shaped cap, said cap including a tubular portion having an internal diameter greater than said tubular transfer member, and an open proximate end, a radial rim portion adjacent said open end and a closed distal end, said tubular transfer member including a circular relatively sharp sealing lip surrounding said tubular portion of said tubular transfer member, said method including assembling said fluid transfer assembly by inserting said piercing member in said tubular transfer member with said piercing end adjacent said proximate end of said tubular transfer member, receiving said cap over said tubular transfer member with said closed distal end enclosing said distal ends of said tubular transfer member and said piercing member, then assembling said tubular transfer member, piercing member and cap on said rim portion of said stopper with said tubular transfer member and said piercing member in generally coaxial alignment with said open end of said vial, generally perpendicular to said stopper rim portion, then securing said assembly on said vial with said collar and simultaneously compressing said proximate end of said tubular transfer member against said stopper, compressing said relatively sharp circular sealing lip against said stopper rim portion, stretching said lip portion over said vial open end and sealing communication between said piercing member external channel and said tubular transfer member when said piercing member pierces said stopper.

29. The method of transferring fluid medicament between a conventional sealed vial and a second container as defined in claim 28, wherein said piercing member is assembled in said tubular transfer member with said piercing end extending beyond said tubular transfer member proximate end, said method then including compressing said tubular transfer member on said stopper rim portion with said piercing end of said piercing member deforming said stopper.

30. The method of transferring fluid medicament between a conventional sealed vial and a second container as defined in claim 29, wherein said radial rim portion of said cap includes a circular sealing lip surrounding said tubular portion of said cap adjacent to said tubular portion, said method including pressing said circular sealing lip of said cap against said rim portion of said stopper, providing a seal surrounding said piercing member.

31. The method of transferring fluid medicament between a conventional sealed vial and a second container as defined in claim 20, wherein said fluid transfer assembly includes a cup-shaped cap including a portion surrounding said transfer member having a closed distal end and a frangible connector portion spaced from said closed distal end, said method including mounting said fluid transfer assembly on said vial with said cup-shaped cap enclosing said transfer assembly by securing said collar on said rim portion of said vial and said collar overlying said frangible connector portion of said cap.

32. The method of transferring fluid medicament between a conventional sealed vial and a second container as defined in claim 31, wherein said cup-shaped cap includes a tubular portion and a radial portion overlying said rim portion of said stopper, said collar having a tubular portion, a radial portion and a distal tubular portion and said frangible connector portion located in said distal tubular portion of said transfer member between said radial portion and said closed end portion, said method including telescopically receiving said collar tubular portion over said radial portion of said cap and said rim portion of said vial, said radial portion of said collar overlying said rim portion of said stopper and said distal tubular[]portion of said collar surrounding a portion of said tubular portion of said cap and said frangible connector portion, and a free end of said tubular portion located beneath said rim portion of said vial retaining said fluid transfer assembly on said vial.

33. A method of assembling a fluid transfer assembly on a conventional vial for transferring fluid between said vial and a second container, said vial having an open end, a rim surrounding said open end, a reduced diameter neck adjacent said rim, and a resilient pierceable stopper received in and sealing said vial open end, said stopper having a rim portion received over said vial rim, said method comprising:

inserting an elongated piercing member having a piercing end and an opposed distal end into a tubular fluid transfer member having an internal surface supporting said piercing member for telescopic movement in said tubular fluid transfer member, said tubular fluid transfer member including an open proximate end adjacent said piercing end of said piercing member having a projecting sealing lip and an open distal end;

inserting said tubular fluid transfer member into a cup-shaped cap, said cup-shaped cap including a tubular portion having an open proximate end which receives said tubular fluid transfer member and said piercing member and a frangible connector portion, a radial rim portion adjacent said open proximate end and a closed distal end adjacent said distal ends of said tubular fluid transfer member and said piercing member; and securing said fluid transfer assembly on said vial rim with a generally tubular collar by locating said cap, tubular fluid transfer member and piercing member on said rim portion of said stopper with said tubular fluid transfer member and piercing member generally coaxially aligned with said vial opening, said generally tubular collar having a distal tubular portion surrounding a portion of said tubular portion and said cap and said frangible connector portion an intermediate radially inwardly projecting portion overlying said rim portion of said cap, a tubular portion surrounding said radial portion of said cap and said vial rim and a radial portion received in said vial neck beneath said rim and simultaneously compressing said sealing lip of said tubular fluid transfer member against said rim portion of said stopper, stretching said stopper rim portion over said vial opening and sealing communication between said tubular fluid transfer member and said vial opening when said piercing end of said piercing member pierces said stopper.

34. The method of assembling a fluid transfer assembly on a conventional vial as defined in claim 31, wherein said method includes assembling said piercing member in said tubular fluid transfer member such that said piercing end extends beyond said proximate end of said tubular fluid transfer member and said piercing member restrained from moving further into said tubular fluid transfer member, said method further including compressing said piercing end of said piercing member into said rim portion of said stopper, deforming said stopper as said sealing lip of said tubular fluid transfer member is compressed into said stopper rim portion.

35. The method of assembling a fluid transfer assembly on a conventional vial as defined in claim 32, wherein said radial rim portion of said cap includes a projecting sealing lip surrounding said tubular portion of said cap and said method including compressing said sealing lip of said cap against said rim portion of said stopper as said sealing lip of said tubular fluid transfer member is compressed into said rim portion of said stopper, providing a seal maintaining the sterility of said fluid transfer assembly.

36. The method of assembling a fluid transfer assembly on a conventional vial as defined in claim 33, wherein said method further includes transferring fluid from said vial to a conventional syringe or vice versa, wherein said distal end of said tubular fluid transfer member includes a threaded connector, said method including removing said closed distal end of said cap, threading the threaded connector of a conventional syringe to said threaded connector of said tubular fluid transfer member and transferring fluid by moving the plunger of the syringe.

37. The method of assembling a fluid transfer assembly on a conventional vial as defined in claim 32, wherein said syringe includes a tubular portion, a plunger having a head reciprocally mounted in sealed relation within said tubular portion and a reduced diameter nozzle portion extending beyond said tubular portion in fluid communication with said tubular portion, said distal end of said tubular fluid transfer member having a threaded connection and said syringe having a mating threaded connection, said method including threading said syringe threaded connector on said threaded connector of said tubular fluid transfer member, thereby driving said nozzle portion of said syringe against said distal end of said piercing member and said piercing end of said piercing member through said stopper rim portion, thereby establishing fluid communication between said vial and said syringe through said tubular transfer member and permitting transfer of fluid from said syringe to said vial or from said vial to said syringe by movement of said plunger in said tubular portion of said syringe.

38. The method of assembling a fluid transfer assembly on a conventional vial as defined in claim 32, wherein said second container is a syringe which includes a tubular portion, a plunger having a head reciprocally mounted in sealed relation within said tubular portion and a reduced diameter nozzle portion opposite said plunger head in communication with said tubular portion, wherein said syringe is initially filled with fluid and said plunger is retracted within said syringe tubular portion and said piercing member distal end is generally closed, said method including attaching said syringe connector to said connector on said tubular fluid transfer member, establishing communication between said nozzle portion of said syringe and said distal end of said tubular fluid transfer member, then driving said plunger of said syringe toward said nozzle portion, driving fluid against a radial sealing portion of said piercing member and driving said piercing end of said piercing member through said stopper and thereby establishing fluid communication between said syringe and said vial.

39. A method of securing a fluid transfer assembly on a conventional vial and stopper assembly, said vial having an open end, a radial rim portion surrounding said open end and a reduced diameter neck portion adjacent said open end, said stopper formed of an elastomeric material and including a tubular portion received in said vial open end and an integral generally planar rim portion overlying said vial rim portion, said method comprising:

assembling said fluid transfer assembly on said stopper generally planar rim portion, said fluid transfer assembly including a generally flat annular surface overlying said planar rim portion of said stopper having a circular sealing lip having a relatively sharp edge projecting from generally flat annular surface;

securing said fluid transfer assembly on said vial stopper assembly with a generally tubular collar formed of a malleable metal, said collar including a tubular portion having an inside diameter slightly greater than an outside diameter of said vial rim portions an integral intermediate radially inwardly projecting annular portion and a distal tubular portion, said method including disposing said generally tubular collar over said fluid transfer assembly with said tubular portion received over said vial rim portion, said collar radially inwardly projecting annular portion receiving said generally flat annular surface of said fluid transfer assembly and said distal tubular portion surrounding a portion of fluid transfer assembly, compressing said sharp edge of said circular sealing lip projecting from said flat annular surface into said stopper generally planar rim portion and crimping a distal end of said collar tubular portion into said vial neck beneath said vial rim.

40. The method of securing a fluid transfer assembly on a conventional vial and stopper assembly as defined in claim 39, wherein said circular sealing lip has a diameter less than an inside diameter of said vial open end and said stopper tubular portion, such that said circular sealing lip overlies an unsupported central portion of said stopper generally planar rim portion, said method including compressing said circular sealing lip into said stopper generally planar rim portion as said distal end of said collar tubular portion is crimped into said vial neck portion, said circular sealing lip stretching and prestressing said central portion of said stopper planar rim portion.

41. The method of securing a fluid transfer assembly on a conventional vial and stopper assembly as defined in claim 40, wherein said fluid transfer assembly includes a piercing member having a piercing end supported in said fluid transfer assembly generally perpendicular to said stopper planar rim portion and said piercing end of said piercing member extending beyond said generally flat annular surface, said method including compressing said piercing end of said piercing member into said stopper generally planar rim portion to partially, but not totally penetrate said generally planar rim portion of said stopper as said collar tubular portion is crimped into said vial neck portion.

* * * * *